US007289746B2

(12) United States Patent
Yamada et al.

(10) Patent No.: US 7,289,746 B2
(45) Date of Patent: Oct. 30, 2007

(54) CHARGING DEVICE, PROCESS CARTRIDGE, AND IMAGE FORMING APPARATUS

(75) Inventors: Masaaki Yamada, Tokyo (JP); Tomoko Takahashi, Kanagawa (JP); Shuji Hirai, Tokyo (JP); Yoshinori Nakagawa, Kanagawa (JP); Yasushi Nakazato, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 177 days.

(21) Appl. No.: 11/006,735

(22) Filed: Dec. 8, 2004

(65) Prior Publication Data

US 2005/0169660 A1 Aug. 4, 2005

(30) Foreign Application Priority Data

| | | |
|---|---|---|
| Dec. 8, 2003 | (JP) | 2003-409021 |
| Jun. 17, 2004 | (JP) | 2004-179479 |
| Jul. 9, 2004 | (JP) | 2004-203013 |

(51) Int. Cl.
*G03G 21/20* (2006.01)

(52) U.S. Cl. ..... 399/92; 399/93

(58) Field of Classification Search ..... None
See application file for complete search history.

(56) References Cited

U.S. PATENT DOCUMENTS

| | | | | |
|---|---|---|---|---|
| 6,716,658 | B2 * | 4/2004 | Park | 438/30 |
| 2002/0055052 | A1 * | 5/2002 | Komoto et al. | 430/108.22 |

FOREIGN PATENT DOCUMENTS

| | | | |
|---|---|---|---|
| JP | 60-95459 | | 5/1985 |
| JP | 5-72871 | | 3/1993 |
| JP | 8-16073 | | 1/1996 |
| JP | 11059933 | A * | 3/1999 |
| JP | 11-305522 | | 11/1999 |
| JP | 3352573 | | 9/2002 |
| JP | 2004-163483 | | 6/2004 |
| JP | 2004-252056 | | 9/2004 |

OTHER PUBLICATIONS

U.S. Appl. No. 11/370,057, filed Mar. 8, 2006, Yamada et al.
U.S. Appl. No. 11/370,823, filed Mar. 9, 2006, Nakagawa et al.
U.S. Appl. No. 11/376,434, filed Mar. 16, 2006, Takahashi et al.

* cited by examiner

*Primary Examiner*—Vincent Q. Nguyen
(74) *Attorney, Agent, or Firm*—Oblon, Spivak, McClelland, Maier & Neustadt, P.C.

(57) ABSTRACT

A charging device includes a case that surrounds a charging unit and has plural ventilating sections, a gas separating unit that varies a component ratio of the air near an opposed portion of a photosensitive member and the charging unit, and a gas electrolyzing unit that electrolyzes moisture of the area near the opposed portion. The gas separating unit has a nitrogen enriching unit that includes a nitrogen enriching film set in a ventilating section and a pressurizing chamber for forming a pressure difference between the inside and the outside of the case and supplies a nitrogen enriched air to the inside of the case or an oxygen enriching unit that includes an oxygen enriching film set in another ventilating section and a depressurizing chamber for forming a pressure difference between the inside and the outside of the case and exhausts an oxygen enriched air to the outside of the case.

11 Claims, 11 Drawing Sheets

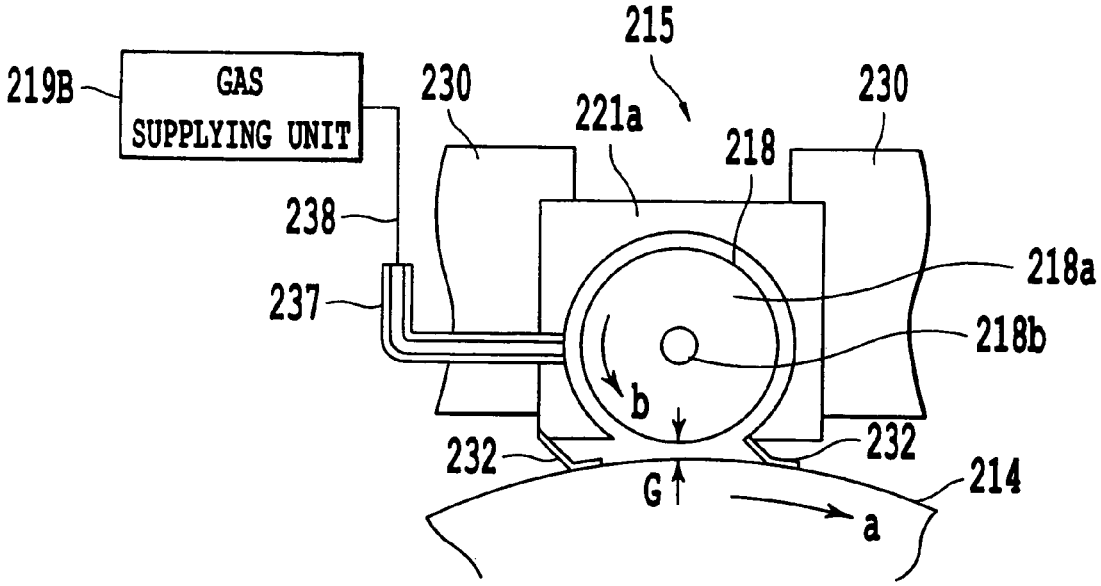
*Fig. 15*
PHOTOSENSITIVE DRUM N2 CHARGING RESULT
*Fig. 16A* 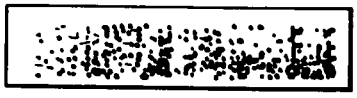 N2 CONCENTRATION 80%
PHOTOSENSITIVE DRUM N2 CHARGING RESULT
*Fig. 16B* 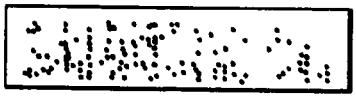 N2 CONCENTRATION 85%
PHOTOSENSITIVE DRUM N2 CHARGING RESULT
*Fig. 16C* 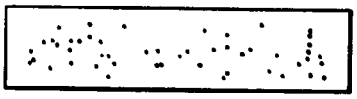 N2 CONCENTRATION 90%
PHOTOSENSITIVE DRUM N2 CHARGING RESULT
*Fig. 16D* 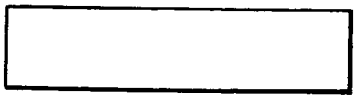 N2 CONCENTRATION 100%

CHARGING DEVICE, PROCESS CARTRIDGE, AND IMAGE FORMING APPARATUS

CROSS-REFERENCE TO RELATED APPLICATIONS

The present document incorporates by reference the entire contents of Japanese priority documents, 2003-409021 filed in Japan on Dec. 8, 2003, 2004-179479 filed in Japan on Jun. 17, 2004 and 2004-203013 filed in Japan on Jul. 9, 2004.

BACKGROUND OF THE INVENTION

1) Field of the Invention

The present invention relates to an image forming apparatus that uses an electrophotographic system like a copying machine, a printer, a facsimile, or a multifunction product including functions of the foregoing, and a charging device and a process cartridge that are used in such an image forming apparatus.

2) Description of the Related Art

Conventionally, image forming apparatuses like a copying machine, a printer, and a facsimile adopting an image forming method according to the electrophotographic system have been widespread. Image formation according to the electrophotographic system is performed as described below. First, an outer peripheral surface of a photosensitive member, on which a resistance and the like change according to a degree of light irradiation, is uniformly charged, and a laser beam or the like is irradiated on the outer peripheral surface of the photosensitive drum, whereby an electrostatic latent image corresponding to an output image is formed thereon. Then, a charged toner is deposited on the electrostatic latent image formed on the outer peripheral surface of the photosensitive member to develop the electrostatic latent image and form a toner image. Subsequently, the toner image formed on the outer peripheral surface of the photosensitive member is transferred onto a recording medium, and heat and pressure are applied to the recording medium on which the toner image is transferred, whereby the toner image is fixed on the recording medium.

As a method of charging the outer peripheral surface of the photosensitive member, a corona charging method, a contact charging method, a non-contact charging method, and the like are known. In the corona charging method, a wire of tungsten or the like is disposed in parallel with the photosensitive member along a longitudinal direction of the photosensitive drum, corona discharge is caused by applying a high voltage of several kilovolts to the wire to ionize elements in the air around the wire, and the ions are deposited on the outer peripheral surface of the photosensitive member. In the contact charging method, a charging roller is arranged in contact with the outer peripheral surface of the photosensitive member, corona discharge is caused in a gap portion between the charging roller and the photosensitive member by applying a voltage to the charging roller, and the outer peripheral surface of the photosensitive member is charged by this corona discharge. In the non-contact method, a charging roller is arranged with a very small space between the charging roller and the outer peripheral surface of the photosensitive member, corona discharge is caused in a gap portion between the charging roller and the photosensitive member by applying a voltage to the charging roller, and the outer peripheral surface of the photosensitive member is charged by this corona discharge.

According to the corona charging method, corona discharge is caused in the wire and ions generated by this corona discharge are deposited on the outer peripheral surface of the photosensitive member. Thus, electric power used for charging the photosensitive member is only 5 to 30% of electric power supplied to the wire, and effective use of the electric power is not realized. On the other hand, according to the contact charging method and the non-contact charging method, since corona discharge occurs between the charging roller and the photosensitive member, it is possible to realize effective use of electric power.

In addition, as disclosed in Japanese Patent Application Laid-Open No. S60-95459 and Japanese Patent Application Laid-Open No. H11-305522, the inventions are proposed which supplies a low oxygen gas to an area where, corona discharge is performed to thereby reduce ozone (O3) and nitrogen oxides (NOx) which are generated when the air in the atmosphere is ionized according to corona discharge. Conventionally, in this type of image forming apparatuses using the electrophotographic system, a contact-type charging device adopting a charging roller instead of a corona charging device is often used for the purpose of limiting generation of ozone and nitrogen oxides (NOx) in a charging process.

However, even in such a charging device adopting a charting roller, ozone and nitrogen oxides are still generated in a charging processing, although quantities thereof are not so large compared with those in the corona charging device. Since a discharge area is near the surface of a photosensitive member (image bearing member), when a corona product like ozone is generated, the corona product is deposited on the surface of the photosensitive member to deteriorate the surface. As a result, blots and blurs occur in an image formed on the photosensitive member to deteriorate an image quality.

To solve these problems, Japanese Patent Application Laid-Open No. H11-305522 and the like disclose a technique for closing an outer periphery of a charging roller with a cover and supplying a low oxygen gas generated outside the charging roller to the inside of the cover to thereby reduce a corona product such as ozone in the discharge area.

The conventional image forming apparatuses described above have a problem in that the image forming apparatuses are large and expensive. In the image forming apparatus disclosed in Japanese Patent Application Laid-Open No. H11-305522, it is necessary to set a large low oxygen gas generator for generating a low oxygen gas outside the cover closing the outer periphery of the charging roller. Therefore, the image forming apparatus is inevitably large and expensive.

In addition, in the image forming apparatus disclosed in Japanese Patent Application Laid-Open No. H11-305522, a low oxygen gas with a predetermined flow rate is injected into the cover. Thus, when air tightness in the cover is not secured, it is likely that the low oxygen gas leaks from the cover to cause a large air flow that scatters a toner into the image forming apparatus. Thus, when the flow rate is controlled to prevent the large air flow from being caused, since a predetermined low oxygen concentration cannot be obtained unless air tightness in the cover is increased, a sealing structure for closing the charging roller is complicated and assemblability of the image forming apparatus is hindered.

When the low oxygen gas is supplied, the low oxygen gas is supplied after moisture is removed as much as possible as impurities to prevent moisture condensation in a gas supply device. Consequently, the low oxygen gas is in an extremely low humidity state. Thus, when the charging device is used under a low humidity environment, abnormal discharge tends to occur, charging abnormality of the photosensitive member is caused by the abnormal discharge, and an image quality of an image to be formed is deteriorated.

Moreover, according to the conventional contact charging method and non-contact charging method, discharge is performed between the charging roller and the photosensitive member. Thus, an impact of the discharge acts on the outer peripheral surface of the photosensitive member, and the outer peripheral surface of the photosensitive member tends to be deteriorated by the impact of the discharge. In particular, when a voltage obtained by superimposing an AC voltage of a peak-to-peak voltage about twice as large as a breakdown voltage on a DC voltage is applied to make charging on the photosensitive drum uniform, the number of times of discharge increases significantly according to a frequency of the AC voltage, the impact acting on the photosensitive member increases significantly according to the discharge, and the deterioration of the photosensitive member becomes noticeable.

According to the inventions disclosed in Japanese Patent Application Laid-Open No. S60-95459 and Japanese Patent Application Laid-Open No. H11-305522, since a gas with an oxygen concentration lower than that of the atmosphere is supplied to the discharge area, it is considered that an amount of generation of ozone and nitrogen oxides can be reduced. However, since the inventions do no consider a voltage to be applied for discharge at all, deterioration of the photosensitive member due to the impact of discharge cannot be reduced. Moreover, when the oxygen concentration of the gas supplied to the discharge area is lowered, the breakdown voltage falls according to the Paschen's law when a ratio of nitrogen increases following the decline of the oxygen concentration. Thus, if the voltage to be applied for discharge is not considered at all, the impact of discharge on the photosensitive member increases and the deterioration of the photosensitive member increases.

SUMMARY OF THE INVENTION

It is an object of the present invention to solve at least the problems in the conventional technology.

A charging device according to an aspect of the present invention includes a charging unit that charges an image bearing member; a gas separating unit that controls percentage of air present between the image bearing member and the charging unit; and a gas electrolyzing unit that electrolyzes moisture in the air present between the image bearing member and the charging unit.

A process cartridge according to another aspect of the present invention includes an image bearing member; a charging device that charges the image bearing member; and at least one process device of a developing device, which develops an electrostatic latent image formed on the image bearing member, a cleaning device, which scraps-off toner remaining on the image bearing member, wherein the image bearing member, the charging device, and the process device are integrated as a cartridge that can be detachably attachable to a body of an image forming apparatus. The charging device includes a charging unit that charges the image bearing member; a gas separating unit that controls percentage of air present between the image bearing member and the charging unit; and a gas electrolyzing unit that electrolyzes moisture in the air present between the image bearing member and the charging unit.

A process cartridge according to still another aspect of the present invention includes an image bearing member; a charging device that charges an image bearing member; at least one process device of a developing device, which develops an electrostatic latent image formed on the image bearing member; and a cleaning device, which scraps-off toner remaining on the image bearing member, wherein the image bearing member, the charging device, the process device, and the cleaning device are integrated as a cartridge that can be detachably attachable to a body of an image forming apparatus. The charging device includes a charging unit that charges the image bearing member; a gas separating unit that controls percentage of air present between the image bearing member and the charging unit; and a gas electrolyzing unit that electrolyzes moisture in the air present between the image bearing member and the charging unit.

An image forming apparatus according to still another aspect of the present invention includes an image bearing member; a charging device that charges the image bearing member; a developing device that develops an electrostatic latent image formed on the image bearing member; a gas separating unit that controls percentage of air present between the image bearing member and the charging unit; and a gas electrolyzing unit that electrolyzes moisture in the air present between the image bearing member and the charging unit.

An image forming apparatus according to still another aspect of the present invention includes an image bearing member; a charging device that charges the image bearing member; and a developing device that develops an electrostatic latent image formed on the image bearing member. The charging device includes a charging unit that charges the image bearing member; a gas separating unit that controls percentage of air present between the image bearing member and the charging unit; and a gas electrolyzing unit that electrolyzes moisture in the air present between the image bearing member and the charging unit.

An image forming apparatus according to still another aspect of the present invention includes a process cartridge that houses an image bearing member; a charging device that charges the image bearing member; and at least one process device of a developing device, which develops an electrostatic latent image formed on the image bearing member, a cleaning device, which scraps-off toner remaining on the image bearing member, wherein the image bearing member, the charging device, and the process device are integrated as a cartridge that can be detachably attachable to a body of an image forming apparatus. The charging device includes a charging unit that charges the image bearing member; a gas separating unit that controls percentage of air present between the image bearing member and the charging unit; and a gas electrolyzing unit that electrolyzes moisture in the air present between the image bearing member and the charging unit.

An image forming apparatus according to still another aspect of the present invention includes a process cartridge that houses at least one of an image bearing member; a charging device that charges the image bearing member; and at least one process device of a developing device, which develops an electrostatic latent image formed on the image bearing member, a cleaning device, which scraps-off toner remaining on the image bearing member, wherein the image bearing member, the charging device, and the process device are integrated as a cartridge that can be detachably attachable to a body of an image forming apparatus. The charging device includes a charging unit that charges the image bearing member; a gas separating unit that controls percentage of air present between the image bearing member and the charging unit; and a gas electrolyzing unit that electrolyzes moisture in the air present between the image bearing member and the charging unit.

A charging device according to still another aspect of the present invention includes a charging unit that charges a photosensitive member by means of corona discharge; a gas supplying unit that supplies a gas having a breakdown voltage lower than that in an atmosphere to an area where corona discharge is performed; and a voltage applying unit that sets a voltage, which is applied to the charging unit to charge the photosensitive member to a necessary charging potential with corona discharge, to a voltage lower than a voltage that is applied to the charging unit to charge the photosensitive member to a necessary charging potential with corona discharge in the atmosphere.

A process cartridge according to still another aspect of the present invention supports both a photosensitive member and a charging unit for charging the photosensitive member with corona discharge and is detachably mounted in a body case. An area where corona discharge is performed around the charging unit is filled with a gas that is supplied form a gas supplying unit and has a breakdown voltage lower than that in an atmosphere, and a voltage, which is applied to the charging unit from a voltage applying unit to charge the photosensitive member with corona discharge, is set to a voltage lower than the voltage that is applied to the charging unit to charge the photosensitive member with corona discharge in the atmosphere.

An image forming apparatus according to still another aspect of the present invention includes a process cartridge that supports both a photosensitive member and a charging unit for charging the photosensitive member with corona discharge and is detachably mounted in a body case. An area where corona discharge is performed around the charging unit is filled with a gas that is supplied form a gas supplying unit and has a breakdown voltage lower than that in an atmosphere, and a voltage, which is applied to the charging unit from a voltage applying unit to charge the photosensitive member with corona discharge, is set to a voltage lower than the voltage that is applied to the charging unit to charge the photosensitive member with corona discharge in the atmosphere. Moreover, the image forming apparatus includes a gas supplying unit that supplies a gas having a breakdown voltage lower than that in an atmosphere to an area where corona discharge is performed in the process cartridge; a voltage applying unit that sets a voltage, which is applied to the charging unit to charge the photosensitive member in the processing cartridge with corona discharge, to a voltage lower than a voltage that is applied to the charging unit to charge the photosensitive member with corona discharge in the atmosphere; an exposing device that exposes the photosensitive member in the process cartridge to light based on image data to thereby form an electrostatic latent image on the photosensitive member; and a transfer device that transfers a toner image formed by developing the electrostatic latent image with a developing device to a recording medium.

An image forming apparatus according to still another aspect of the present invention includes a photosensitive member; a charging device that uniformly charges the photosensitive member. The charging device includes a charging unit that charges a photosensitive member by means of corona discharge; a gas supplying unit that supplies a gas having a breakdown voltage lower than that in an atmosphere to an area where corona discharge is performed; and a voltage applying unit that sets a voltage, which is applied to the charging unit to charge the photosensitive member to a necessary charging potential with corona discharge, to a voltage lower than a voltage that is applied to the charging unit to charge the photosensitive member to a necessary charging potential with corona discharge in the atmosphere; an exposing device that exposes the photosensitive member after being charged uniformly to light based on image data to thereby form an electrostatic latent image on the photosensitive member; a developing device that develops the electrostatic latent image formed on the photosensitive member to form a toner image; and a transfer device that transfers the developed toner image to a recording medium.

A charging device according to still another aspect of the present invention includes a charging unit that charges a photosensitive member opposed to the charging unit with corona discharge; a DC voltage applying unit that applies a DC voltage to the charging unit to charge the photosensitive member to a necessary charging potential with corona discharge; and a gas supplying unit that supplies a gas having a nitrogen concentration higher than that of an atmosphere to a discharge area where corona discharge is performed between the charging unit and the photosensitive member.

A process cartridge according to still another aspect of the present invention includes supports both a photosensitive member and a charging unit for charging the photosensitive member with corona discharge and is detachably mounted in a body case. A discharge area where corona discharge between the photosensitive member and the charging unit is performed is filled with a gas that is supplied form a gas supplying unit and has a nitrogen concentration higher than that of an atmosphere, and a DC voltage for charging the photosensitive member with corona discharge is applied to the charging unit.

An image forming apparatus according to still another aspect of the present invention includes a process cartridge that supports both a photosensitive member and a charging unit for charging the photosensitive member with corona discharge and is detachably mounted in a body case. A discharge area where corona discharge between the photosensitive member and the charging unit is performed is filled with a gas that is supplied form a gas supplying unit and has a nitrogen concentration higher than that of an atmosphere, and a DC voltage for charging the photosensitive member with corona discharge is applied to the charging unit. The image forming apparatus further includes a gas supplying unit that supplies a gas having a nitrogen concentration higher than that of an atmosphere to a discharge area where corona discharge in the process cartridge is performed; a DC voltage applying unit that applies a DC voltage to the charging unit to charge the photosensitive member in the process cartridge with corona discharge; an exposing device that exposes the photosensitive member in the process cartridge to light based on image data to thereby form an electrostatic latent image on the photosensitive member; and a transfer device that transfers a toner image formed by developing the electrostatic latent image with a developing device to a recording medium.

An image forming apparatus according to still another aspect of the present invention includes a photosensitive member; a charging device that uniformly charges the photosensitive member. The charging device includes a charging unit that charges a photosensitive member opposed to the charging unit with corona discharge; a DC voltage applying unit that applies a DC voltage to the charging unit to charge the photosensitive member to a necessary charging potential with corona discharge; and a gas supplying unit that supplies a gas having a nitrogen concentration higher than that of an atmosphere to a discharge area where corona discharge is performed between the charging unit and the photosensitive member; an exposing device that exposes the photosensitive member after being charged uniformly to light based on image data to thereby form an electrostatic latent image on the photosensitive member; a developing device that develops the electrostatic latent image formed on the photosensitive member to form a toner image; and a transfer device that transfers the developed toner image to a recording medium.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 15 is a longitudinal sectional view of the charging device;

FIGS. 16A to 16D are photographs of a result of observing a background contamination state by performing development processing after charging a photosensitive member with a nitrogen concentration of a gas in a discharge area varied;

DETAILED DESCRIPTION

Exemplary embodiments of the present invention will be hereinafter explained in detail with reference to the accompanying drawings.

Figure 1:
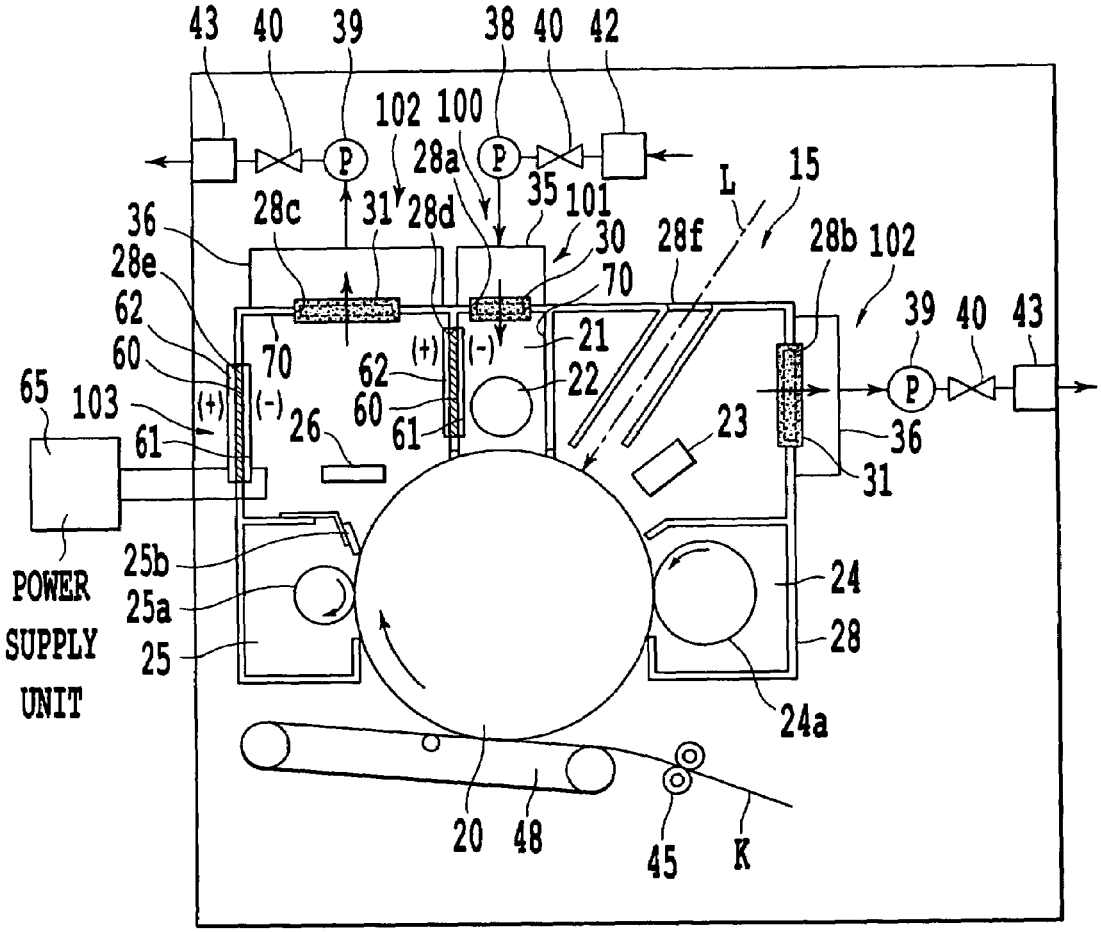
FIG. 1 is a schematic front view of an example of a structure near a process cartridge and a transfer device according to a first embodiment of the invention.

A first embodiment of the invention will be explained with reference to FIG. 1 and FIGS. 2A and 2B. The first embodiment relates to an example of application of the invention to an image forming apparatus using a process cartridge. FIG. 1 is a schematic front view of an example of a structure near a process cartridge and a transfer device.

In FIG. 1, reference numeral 15 denotes a process cartridge constituted to be detachably attachable to an image forming apparatus body 1. This process cartridge 15 has a drum-like photosensitive member 20 serving as an image bearing member in the center and is constituted by integrating process devices as a cartridge using a cartridge case 28 surrounding these process devices. The process devices include a charging device 21 having a charging roller 22 serving as a charging unit that is opposed to the photosensitive member 20 and charges the surface of the photosensitive member 20, a potential sensor 23 that detects a potential on the surface of the photosensitive member 20, a developing device 24 that develops an electrostatic latent image formed on the surface of the photosensitive member 20 with a toner, a cleaning device 25 that collects an untransferred toner on the photosensitive member 20, and a charge eliminating device 26 that resets a surface potential of the photosensitive member 20. Note that the process cartridge may be constituted by any assembly as long as the photosensitive member (image bearing member) 20, the charging device 21, and at least one process device of the developing device 24 and the cleaning device 25 are integrated as a cartridge in the assembly and the assembly is detachably attachable to the image forming apparatus body 1. The process cartridge does not always have to include all of these process devices.

The cartridge case 28 surrounds the photosensitive member 20, the charging device 21, the potential sensor 23, the developing device 24, the cleaning device 25, the charge eliminating device 26, and the like, has partitions formed toward the photosensitive member 20 side for the respective device portions, and supports members constituting the respective devices. A part (in an example shown in the figure, a lower end part) of the photosensitive member 20 is exposed from the cartridge case 28, and the process cartridge 15 is disposed such that this exposed part of the photosensitive member 20 is opposed to a transfer device 48. Note that the inside of the cartridge case 28 is in a substantially closed state.

In such a basic structure, a nitrogen enriching film 30 is set in an opening (ventilating section) 28*a* that is formed in a portion of the cartridge case 28 opposed to the charging device 21, and oxygen enriching film 31 are set in openings (ventilating sections) 28*b* and 28*c* formed in portions of the cartridge case 28 opposed to the potential sensor 23 and the charge eliminating device 26 in front and behind the charging device 21. A pressurizing chamber (pressure adjusting unit) 35 is provided adjacent to the nitrogen enriching film 30 outside the opening 28*a*, and depressurizing chambers (pressure adjusting units) 36 are provided adjacent to the oxygen enriching films 31 outside the openings 28*b* and 28*c*. A pump 38 is connected to the pressurizing chamber 35 such that it is possible to supply the air into the pressurizing chamber 35 with the pump 38 via an intake port 42. Similarly, pumps 39 are connected to the depressurizing chambers 36 such that it is possible to exhaust the air in the depressurizing chamber 36 with the pumps 39 via exhaust ports 43. Reference numeral 40 denotes valves that control entrance and exit of a gas flowing in tubes.

Solid polymer electrolyte films 60 are set in openings (ventilating sections) 28*d* and 28*e* formed in a partitioning portion of the cartridge case 28 corresponding to the charging device 21 and a portion of the cartridge case 28 corresponding to the charge eliminating device 26. Porous cathodes 61 connected to a cathode of a power supply unit 65 are provided on surfaces in the solid polymer electrolyte films 60 facing the inner side of the cartridge case 28. Porous anodes 62 connected to an anode of the power supply unit 65 are provided on surfaces in the solid polymer electrolyte films 60 facing the outer side of the cartridge case 28. Moreover, a water absorbing resin dispersion 70 is provided on an inner surface side of the cartridge case 28 as a humidity adjustor.

In such a structure, operations related to a usual image forming process of the image forming apparatus will be explained.

First, the photosensitive member 20 driven to rotate in a clockwise direction is charged on the surface thereof in a portion of the photosensitive member 20 opposed to the charging roller 22. Then, the surface of the photosensitive member 20 charged by the charging roller 22 is further rotated to reach an irradiation portion of a laser beam L. Here, an electrostatic latent image corresponding to image information of an original or the like is formed on the surface of the photosensitive member 20. Note that the laser beam L is irradiated from an optical unit (not shown), passes an opening 28*f* of the cartridge case 28, and reaches the surface of the photosensitive member 20.

Thereafter, the surface of the photosensitive member 20, on which the electrostatic latent image is formed, passes a portion opposed to the developing device 24. A predetermined developing bias voltage is applied to a developing roller 24*a* opposed to the photosensitive member 20. A toner carried on the developing roller 24*a* moves to the electrostatic latent image and is deposited thereon according to a potential difference between the developing roller 24*a* and the electrostatic latent image on the surface of the photosensitive member 20.

Thereafter, the surface of the photosensitive member 20 developed by the developing device 24 reaches a portion opposed to the transfer device 48. Here, a toner image on the photosensitive member 20 is transferred onto a transfer material K that is conveyed by a registration roller 45 at predetermined timing. At this point, a small quantity of untransferred toner, which is not transferred onto the transfer material K, remains on the photosensitive member 20.

Thereafter, the surface of the photosensitive member 20 having passed the transfer device 48 reaches a portion opposed to the cleaning device 25. The cleaning device 25 collects the untransferred toner with a brush roller 25*a* and a cleaning blade 25*b* that are in contact with the photosensitive member 20.

Thereafter, the surface of the photosensitive member 20 having passed the cleaning device 25 reaches the charge eliminating device 26. Here, a potential on the surface of the photosensitive member 20 is eliminated, and a series of image creation process ends.

On the other hand, the transfer material K moves as described below. First, the transfer material K is fed from a sheet feeding unit (not shown) to a conveying path. Then, the transfer material K having reached the registration roller 45 is conveyed to the transfer device 48 at the same timing as the toner image created on the photosensitive member 20, and the toner image is transferred onto the transfer material K.

Then, the transfer material K after the transfer process reaches a fixing unit (not shown), and the toner image is fixed by the fixing unit. Finally, the transfer material K after the fixing process passes through a sheet discharge unit (not shown) and is discharged to the outside of the image forming apparatus. In this way, a series of image forming process is completed.

Next, characteristic parts of the first embodiment will be explained. First, a structure and an operation of a gas separating unit will be described in detail. A gas separating unit 100 in the first embodiment includes one nitrogen enriching unit 101 that supplies the nitrogen enriched air (a gas having a high nitrogen component ratio and a low oxygen component ratio compared with the usual air) into the cartridge case 28, which is generally in a closed state, and two oxygen enriching units 102 that exhaust the oxygen enriched air (a gas having a high oxygen component ratio and a low nitrogen component ratio compared with the usual air) to the outside of the cartridge case 28.

Here, the nitrogen enriching unit 101 includes the nitrogen enriching film 30, the pressurizing chamber 35 serving as a pressure adjusting unit, the pump 38, the valve 40, and the intake port 42. On the other hand, the oxygen enriching units 102 include the oxygen enriching films 31, the depressurizing chambers 36 serving as pressure adjusting units, the pumps 39, the valves 40, and the exhaust ports 43.

The nitrogen enriching film 30 and the oxygen enriching films 31, which are set to cover the openings 28*a*, 28*b*, and 28*c* of the cartridge case 28, are members having chemical characteristics as described below.

Figure 2A:
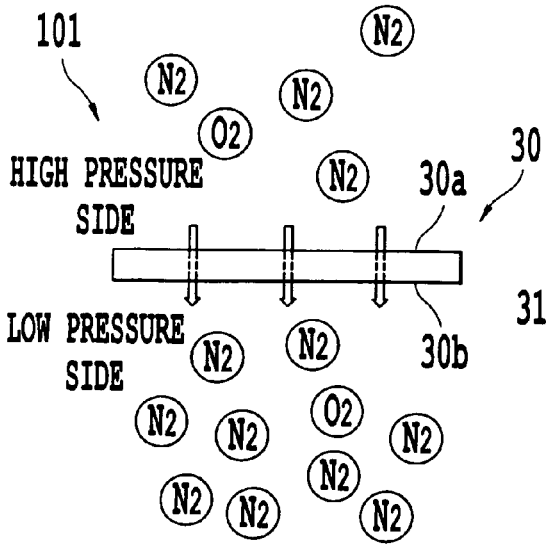
FIGS. 2A and 2B are explanatory diagrams of actions of a nitrogen enriching film and an oxygen enriching film.
Figure 2B:
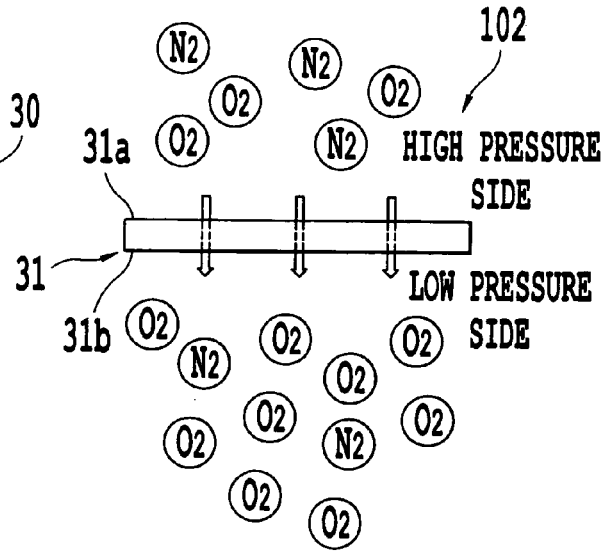

First, as shown in FIG. 2A, the nitrogen enriching film 30 is a member that, by providing a pressure difference between a first surface 30*a* side and a second surface 30*b* side, supplies the nitrogen enriched air from the high-pressure first surface 30*a* side to the low-pressure second surface 30*b* side. On the other hand, the oxygen enriching film 31 is a member that, by providing a pressure difference between a first surface 31*a* side and a second surface 31*b* side, supplies the oxygen enriched air from the high-pressure first surface 31*a* side to the low-pressure second surface 31*b* side.

In this way, the nitrogen enriching film 30 and the oxygen enriching films 31 vary gas component ratios using speed differences of dissolution and diffusion of oxygen and nitrogen with respect to enriching films having predetermined molecular structures. Note that the enriched air is exhausted from the second surfaces 30*b* and 31*b* sides relatively calmly.

Referring to FIG. 1, the nitrogen enriching film 30 is set such that the second surface 30*b* side is the inner side of the cartridge case 28 and the first surface 30*a* side is the pressurizing chamber 35 side. The air is fed from the intake port 42 into the pressurizing chamber 35 by the pressurizing pump 38 connected to the pressurizing chamber 35, whereby a pressure in the closed pressurizing chamber 35 rises.

Consequently, a pressure difference is formed between the inside and the outside of the cartridge case 28 via the nitrogen enriching film 30, and the nitrogen enriched air is supplied from the pressurizing chamber 35 into the cartridge case 28. In this way, when the nitrogen enriched air is supplied into the cartridge case 28 and the oxygen component ratio of the air near the opposed portion of the photosensitive member 20 and the charging roller 22 decreases, a reaction for generating ozone and nitrogen oxides in the charging process in the discharge area (near the opposed portion) slows down. Therefore, as an image formed on the photosensitive member 20, it is possible to provide a high quality image in which blots and blurs due to discharge products never occur.

On the other hand, the oxygen enriching film 31 is set such that the first surface 31*a* side is the inner side of the cartridge case 28 and the second surface 31*b* side is the depressurizing chamber 36 side. A gas in the depressurizing chamber 36 is fed to the exhaust port 43 by the depressurizing pump 39 connected to the depressurizing chamber 36, whereby a pressure in the closed depressurizing chamber 36 falls.

Consequently, a pressure difference is formed between the inside and the outside of the cartridge case 28 via the oxygen enriching film 31, and the oxygen enriched air is exhausted from the inside of the cartridge case 28 to the depressurizing chamber 36. In this way, when the oxygen enriched air is exhausted to the outside of the cartridge case 28 and the oxygen component ratio of the air near the opposed portion of the photosensitive member 20 and the charging roller 22 decreases, a reaction for generating ozone and nitrogen oxides in the charging process in the discharge area slows down. Therefore, it is possible to provide a high quality image in which blots and blurs due to discharge products never occur.

Note that a pressure balance realized by the pressure adjusting units 35, 38, 40, and 42 of the nitrogen enriching unit 101 and the pressure adjusting units 36, 39, 40, and 43 of the two oxygen enriching units 102 is adjusted such that an internal pressure inside the cartridge case 28 is substantially equal to an external pressure outside the cartridge case 28 (a pressure in places other than the pressurizing chamber 35 and the depressurizing chambers 36, which is substantially equal to the atmospheric pressure).

In addition, the oxygen enriched air exhausted from the exhaust port 43 is directly exhausted to the outside of the image forming apparatus body 1. Thus, an environment with a high oxygen concentration and a high relaxation property is obtained around the image forming apparatus.

Next, a structure and an operation of the gas electrolyzing unit will be described in detail. A gas electrolyzing unit 103 according to the first embodiment includes the solid polymer electrolyte films 60 that are provided in the openings 28*d* and 28*e* of the cartridge case 28 with one surfaces thereof facing the inner side of the cartridge case 28 and the other surfaces facing the outer side of the cartridge cases, the porous cathodes 61 that are provided on the surfaces facing the inner side of the cartridge case 28 in this solid polymer electrolyte films 60 and connected to the cathode of the power supply unit 65, and the porous anodes 62 that are provided on the surfaces facing the outer side of the cartridge case 28 in the solid polymer electrolyte films 60 and connected to the anode of the power supply unit 65. By applying a DC current to spaces between the porous cathodes 61 and the porous anodes 62, which are arranged across the solid polymer electrolyte films 60, a water molecule (H2O) is resolved into a hydrogen ion (H+), oxygen (O2), and an electron (e−) in areas opposed to the porous anodes 62. The resolved hydrogen ion passes through the solid polymer electrolyte films 60, moves to the porous cathodes 61 sides, and unites with the oxygen in areas opposed to the porous cathodes 61 to form water. Since the hydrogen and the oxygen form water, it is possible to humidify the inside of the cartridge case 28 even if a low oxygen gas with moisture removed is supplied thereto.

Inside the cartridge case 28, since the oxygen and the hydrogen ion unite, a quantity of oxygen is reduced. Therefore, it is possible to further reduce the oxygen in the inside of the cartridge case 28 in which the oxygen is reduced by the low oxygen gas. Thus, the generation of nitrogen oxides and ozone involved in discharge for charging is controlled, and the decline in an image quality due to the influence of the nitrogen oxides and the ozone is also controlled.

A structure and an operation of the water absorbing resin dispersion 70 will be described. The water absorbing resin dispersion 70 is set on the inner wall surface of the cartridge case 28. The water absorbing resin dispersion 70 is a member that is formed by uniformly dispersing particulates of water absorbing resin. The water absorbing resin dispersion 70 functions to absorb moisture when ambient humidity is equal to or higher than a set value and release the absorbed moisture when the ambient humidity is equal to or lower than the set value to thereby maintain the set value of the ambient humidity.

When the inside of the cartridge case 28 is humidified by the solid polymer electrolyte films 60, since humidity rises to 100% RH to bring the inside of the cartridge case 28 into a saturated state, it is likely that the hydrogen ion electrolyzed by the solid polymer electrolyte films 60 does not unite with the oxygen, and hydrogen is generated to ignite and explode. However, since the water absorbing resin dispersion 70 absorbs moisture to prevent the humidity from rising to 100% RH, the likelihood of the explosion of hydrogen is eliminated. In addition, since the water absorbing resin dispersion 70 absorbs moisture, an amount of union of hydrogen and oxygen is increased by the solid polymer electrolyte films 60 to make it easier to lower an oxygen concentration. The absorbed moisture is released when the humidity is low. Therefore, even when the inside of the cartridge case 28 is brought into a low humidity state due to inflow of a nitrogen gas by the gas separating films, surroundings of the charging roller 22, which are on the inner side of the cartridge case 28, are prevented from being brought into the low humidity state immediately by the moisture released from the water absorbing resin dispersion 70. This makes it possible to shorten a time for applying a DC voltage to the spaces between the porous cathodes 61 and the porous anodes 62 and reduce power consumption compared with the time when the water absorbing resin dispersion 70 is not provided.

As described above, according to the first embodiment, it is possible to reduce an amount of generation of discharge products in the charging process with a relatively simple and inexpensive structure without using a large low oxygen gas generating apparatus or the like. Moreover, according to the first embodiment, since a pressure valance of the inside and the outside of the cartridge case 28 excluding the pressurizing chamber 35 and the depressurizing chamber 36 is kept uniform and the enriched air is exhausted calmly from the gas separating unit 100, it is possible to prevent a large air flow change from occurring between the inside and the outside of the cartridge case 28

A second embodiment of the invention will be explained with reference to FIG. 3. Components identical with or equivalent to those described in the first embodiment are denoted by the identical reference numerals and signs, and explanations of the components are omitted (the same holds true for embodiments to be explained below). The example of application of the invention to the process cartridge 15 is explained in the first embodiment. In the second embodiment, an example of application of the invention to a charging device 16 will be explained. Therefore, the second embodiment is different from the first embodiment in that the gas separating unit 100, the gas electrolyzing unit 103, and the water absorbing resin dispersion 70 serving as a humidity adjusting agent are set in a case 17 surrounding only the charging roller 22.

Figure 3:
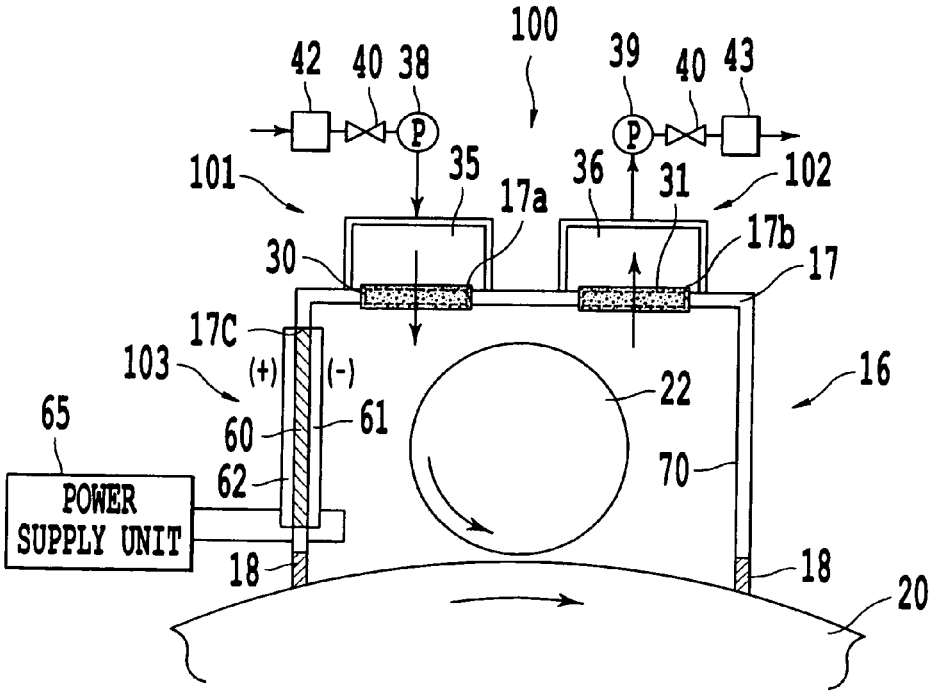
FIG. 3 is a schematic front view of an example of a structure of a charging device according to a second embodiment of the invention.

In FIG. 3, reference numeral 17 denotes a case surrounding the charging roller 22 serving as a charging unit and 18 denotes a seal member that is pasted to the case 17 so as to come into abutment against the photosensitive member 20 to increase air tightness in the case 17.

As shown in FIG. 3, the case 17 of the charging device 16 is constituted to surround the charging roller 22 and support the same. In addition, the inside of the case 17 is set in substantially a closed state by the seal member 18 pasted to the case 17. Note that, as the seal member 18, a member of an optimum material having an optimum abutment pressure is selected to prevent the surface of the photosensitive member 20 rotating in an arrow direction from being damaged by the seal member 18.

The nitrogen enriching unit 101, which supplies the nitrogen enriched air to the inside of the case 17, and the oxygen enriching unit 102, which exhausts the oxygen enriched air to the outside of the case 17, are set in the charging device 16 as the gas separating unit 100. The gas electrolyzing unit 103, which humidifies the inside of the case 17, is also set in the charging device 16. The water absorbing resin dispersion 70 functioning as a humidity adjusting unit is set on an inner wall surface of the case 17.

Note that structures and operations of the nitrogen enriching unit 101, the oxygen enriching unit 102, the gas electrolyzing unit 103, and the water absorbing resin dispersion 70 are the same as those in the first embodiment.

More specifically, the nitrogen enriching film 30 is set in an opening (ventilating section) 17*a* of the case 17 such that the second surface 30*b* side is the inner side of the case 17 and the first surface 30*a* side is the pressurizing chamber 35 side. A pressure difference is formed between the inside and the outside of the case 17 via the nitrogen enriching film 30, and the nitrogen enriched air is supplied from the pressurizing chamber 35 to the inside of the case 17.

On the other hand, the oxygen enriching film 31 is set in an opening (ventilating section) 17*b* of the case 17 such that the first surface 31*a* side is the inner side of the case 17 and the second surface 31*b* side is the depressurizing chamber 36 side. A pressure difference is formed between the inside and the outside of the case 17 via the oxygen enriching film 31, and the oxygen enriched air is exhausted from the inside of the case 17 to the depressurizing chamber 36.

Note that the pressure adjusting units 35, 38, 40, and 42 of the nitrogen enriching unit 101 and the pressure adjusting units 36, 39, 40, and 43 of the oxygen enriching unit 102 are adjusted such that pressures inside and outside the case 17 excluding the pressurizing chamber 35 and the depressurizing chamber 36 are substantially equal.

On the other hand, the gas electrolyzing unit 103 includes the solid polymer electrolyte film 60 that is provided in an opening (ventilating section) 17*c* of the case 17 with one surface thereof facing the inner side of the case 17 and the other surface facing the outer side of the case 17, the porous cathode 61 that is provided on the surface facing the inner side of the case 17 in this solid polymer electrolyte film 60 and connected to the cathode of the power supply unit 65, and the porous anode 62 that is provided on the surface facing the outer side of the case 17 in the solid polymer electrolyte film 60 and connected to the anode of the power supply unit 65. By applying a DC current to a space between the porous cathode 61 and the porous anode 62, which are arranged across the solid polymer electrolyte film 60, a water molecule (H2O) is resolved into a hydrogen ion (H+), oxygen (O2), and an electron (e−) in an area opposed to the porous anode 62. The resolved hydrogen ion passes through the solid polymer electrolyte film 60, moves to the porous cathode 61 side, and unites with the oxygen in an area opposed to the porous cathode 61 to form water. Since the hydrogen and the oxygen form water, it is possible to humidify the inside of the case 17 even if a low oxygen gas with moisture removed is supplied thereto.

Inside the case 17, since the oxygen and the hydrogen ion unite, a quantity of oxygen is reduced. Therefore, it is possible to further reduce the oxygen in the inside of the case 17 in which the oxygen is reduced by the low oxygen gas. Thus, the generation of nitrogen oxides and ozone involved in discharge of the charging roller 22 is controlled, and the decline in an image quality due to the influence of the nitrogen oxides and the ozone is also controlled.

The water absorbing resin dispersion 70 is set on the inner wall surface of the case 17. The water absorbing resin dispersion 70 is a member that is formed by uniformly dispersing particulates of water absorbing resin. The water absorbing resin dispersion 70 functions to absorb moisture when ambient humidity is equal to or higher than a set value and release the absorbed moisture when the ambient humidity is equal to or lower than the set value to thereby maintain the set value of the ambient humidity.

As explained above, in the second embodiment, as in the first embodiment, it is possible to reduce an amount of generation of discharge products in the charging process with a relatively simple and inexpensive structure without using a large low oxygen gas generating apparatus or the like. Moreover, since a pressure valance of the inside and the outside of the case 17 excluding the pressurizing chamber 35 and the depressurizing chamber 36 is kept uniform and the enriched air is exhausted calmly from the gas separating unit 100, it is possible to prevent a large air flow change from occurring between the inside and the outside of the case 17. On the other hand, since the hydrogen ion generated by the solid polymer electrolyte film 60 unites with the oxygen in the case 17, it is possible to further reduce the oxygen in the case 17. In addition, it is possible to prevent abnormal discharge of the charging roller 22 by humidifying the inside of the case 17 in which humidity is lowered by the low oxygen gas. Moreover, by adjusting humidity in the case 17 with the water absorbing resin dispersion 70 to prevent the humidity from rising to 100% RH, since the hydrogen ion generated by the solid polymer electrolyte film 60 easily unites with the oxygen to prevent hydrogen from being generated, it is possible to prevent the likelihood of explosion of hydrogen.

Note that the charging device 16 in the second embodiment may be present as one of process members in an image forming apparatus or may be incorporated in a process cartridge as shown in FIG. 1.

A third embodiment of the invention will be explained with reference to FIG. 4. In the third embodiment, an example of application of the invention to an image forming apparatus itself including the charging device 21 is described. Therefore, the third embodiment is different from the first and the second embodiments in that the gas separating unit 100, the gas electrolyzing unit 103, and the water absorbing resin dispersion 70 serving as a humidity adjusting agent are set in a body case 50 that surrounds not only the photosensitive member 20 but also all other process members.

Figure 4:
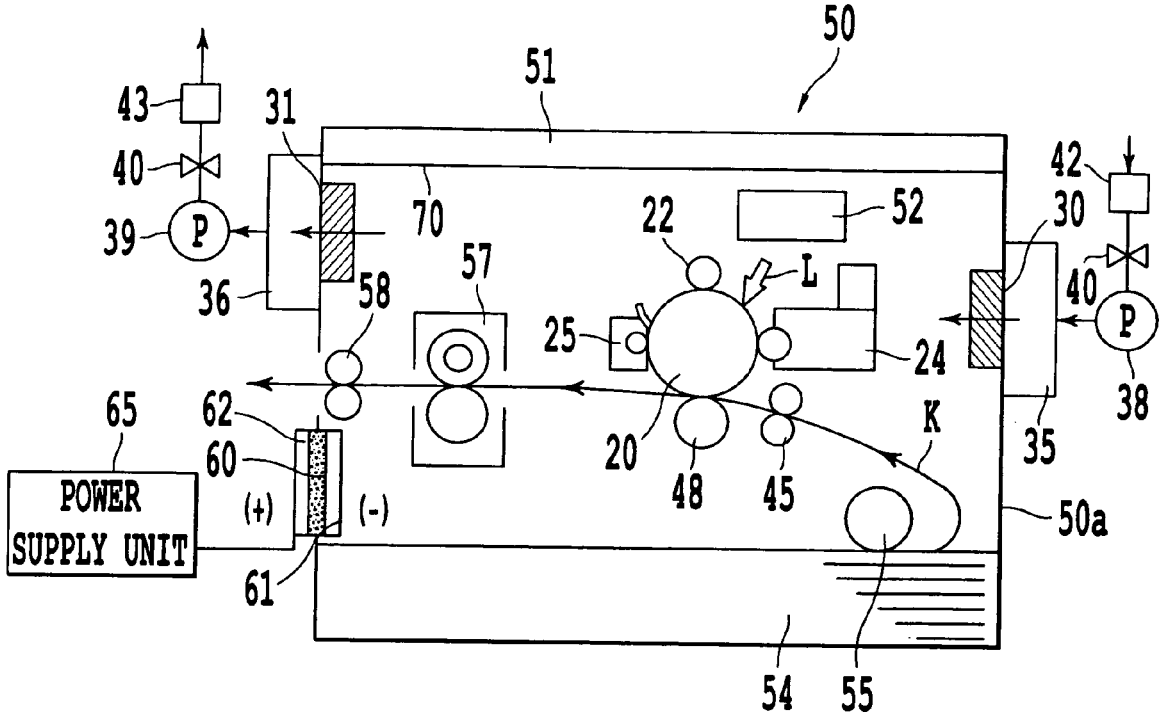
FIG. 4 is a schematic front view of an example of a structure of an image forming apparatus according to a third embodiment of the invention.

In FIG. 4, reference numeral 51 denotes an original reading unit on which an original is placed and which reads image information of the original; 52, an optical unit that irradiates a laser beam L on the photosensitive member 20 based on the image information read by the original reading unit 51; 54, a sheet feeding device that stores a transfer material K; 55, a sheet feeding roller that feeds the transfer material K from the sheet feeding unit 54; 57, a fixing device that fixes a toner image on the transfer material K after a transfer process on the transfer material K; and 58, a sheet discharging device that discharges the transfer material K after a fixing process.

As shown in FIG. 4, the body case 50 is constituted to surround the entire image forming apparatus including the charging roller 22. The inside of the body case 50 is set in a substantially closed state.

The nitrogen enriching unit 101, which supplies the nitrogen enriched air to the inside of the body case 50, the oxygen enriching unit 102, which exhausts the oxygen enriched air to the outside of the body case 50, and the gas electrolyzing unit 103, which humidifies the inside of the body case 50, are set in the body case 50. The water absorbing resin dispersion 70 is set on an inner wall surface of the body case 50.

Note that structures and operations of the nitrogen enriching unit 101, the oxygen enriching unit 102, the gas electrolyzing unit 103, and the water absorbing resin dispersion 70 are the same as those in the embodiments described above.

More specifically, the nitrogen enriching film 30 is set in an opening (ventilating section) 50*a* such that the second surface 30*b* side is the inner side of the body case 50 and the first surface 30*a* side is the pressurizing chamber 35 side. A pressure difference is formed between the inside and the outside of the body case 50 via the nitrogen enriching film 30, and the nitrogen enriched air is supplied from the pressurizing chamber 35 to the inside of the body case 50.

On the other hand, the oxygen enriching film 31 is set in an opening (ventilating section) 50*b* such that the first surface 31*a* side is the inner side of the body case 50 and the second surface 31*b* side is the depressurizing chamber 36 side. A pressure difference is formed between the inside and the outside of the body case 50 via the oxygen enriching film 31, and the oxygen enriched air is exhausted from the inside of the body case 50 to the depressurizing chamber 36.

Note that the pressure adjusting units 35, 38, 40, and 42 of the nitrogen enriching unit 101 and the pressure adjusting units 36, 39, 40, and 43 of the oxygen enriching unit 102 are adjusted such that pressures inside and outside the body case 50 excluding the pressurizing chamber 35 and the depressurizing chamber 36 are substantially equal.

On the other hand, the gas electrolyzing unit 103 includes the solid polymer electrolyte film 60 that is provided in an opening (ventilating section) 50*c* of the body case 50 with one surface thereof facing the inner side of the body case 50 and the other surface facing the outer side of the body case 50, the porous cathode 61 that is provided on the surface facing the inner side of the body case 50 in the solid polymer electrolyte film 60 and connected to the cathode of the power supply unit 65, and the porous anode 62 that is provided on the surface facing the outer side of the body case 50 in the solid polymer electrolyte film 60 and connected to the anode of the power supply unit 65. By applying a DC current to a space between the porous cathode 61 and the porous anode 62, which are arranged across the solid polymer electrolyte film 60, a water molecule (H2O) is resolved into a hydrogen ion (H+), oxygen (O2), and an electron (e−) in an area opposed to the porous anode 62. The resolved hydrogen ion passes through the solid polymer electrolyte film 60, moves to the porous cathode 61 side, and unites with the oxygen in an area opposed to the porous cathode 61 to form water. Since the hydrogen and the oxygen form water, it is possible to humidify the inside of the body case 50 even if a low oxygen gas with moisture removed is supplied thereto.

Inside the body case 50, since the oxygen and the hydrogen ion unite, a quantity of oxygen is reduced. Therefore, it is possible to further reduce the oxygen in the inside of the body case 50 in which the oxygen is reduced by the low oxygen gas. Thus, the generation of nitrogen oxides and ozone involved in discharge of the charging roller 22 is controlled, and the decline in an image quality due to the influence of the nitrogen oxides and the ozone is also controlled.

The water absorbing resin dispersion 70 is set on the inner wall surface of the body case 50. The water absorbing resin dispersion 70 is a member that is formed by uniformly dispersing particulates of water absorbing resin. The water absorbing resin dispersion 70 functions to absorb moisture when ambient humidity is equal to or higher than a set value and release the absorbed moisture when the ambient humidity is equal to or lower than the set value to thereby maintain the set value of the ambient humidity.

As explained above, in the third embodiment, as in the embodiments described above, it is possible to reduce an amount of generation of discharge products in the charging process with a relatively simple and inexpensive structure without using a large low oxygen gas generating apparatus or the like. Moreover, since a pressure valance of the inside and the outside of the body case 50 is kept uniform and the enriched air is exhausted calmly from the gas separating unit 100, it is possible to prevent a large air flow change from occurring between the inside and the outside the body case 50. On the other hand, since the hydrogen ion generated by the solid polymer electrolyte film 60 unites with the oxygen in the body case 50, it is possible to further reduce the oxygen in the body case 50. In addition, it is possible to prevent abnormal discharge of the charging roller 22 by humidifying the inside of the body case 50 in which humidity is lowered by the low oxygen gas. Moreover, by adjusting humidity in the body case 50 with the water absorbing resin dispersion 70 to prevent the humidity from rising to 100% RH, since the hydrogen ion generated by the solid polymer electrolyte film 60 easily unites with the oxygen to prevent hydrogen from being generated, it is possible to prevent the likelihood of explosion of hydrogen.

Note that, in the embodiments described above, both the nitrogen enriching unit 101 and the oxygen enriching unit 102 are used as the gas separating unit 100. However, the invention is not limited to this, and only one of the nitrogen enriching unit 101 and the oxygen enriching unit 102 may be used. In addition, although both the gas electrolyzing unit 103 and the water absorbing resin dispersion 70 are used in the embodiments described above, only one of the gas electrolyzing unit 103 and the water absorbing resin dispersion 70 may be used. Further, since the water absorbing resin dispersion 70 is used as a humidity adjusting agent, it is possible to obtain the same effect when a humidity absorbing agent like zeolite or silica gel is used.

In the embodiments described above, the charging roller 22, which is a contact charging unit, is used as a charging unit. However, it is also possible to apply the invention to other charging means, for example, charging means of a corona discharge system using a wire other than charging means of a contact type like a charging brush. In that case, the same effect as the embodiments described above is realized.

Note that it is evident that the invention is not limited to the embodiments described above and the embodiments can be modified in an appropriate manner within the scope of the technical idea of the invention other than the modifications indicated in the embodiments. In addition, numbers, positions, shapes, and the like of the components are not limited to those described in the embodiments and can be set to numbers, positions, shapes, and the like that are suitable in carrying out the invention.

Figure 5:
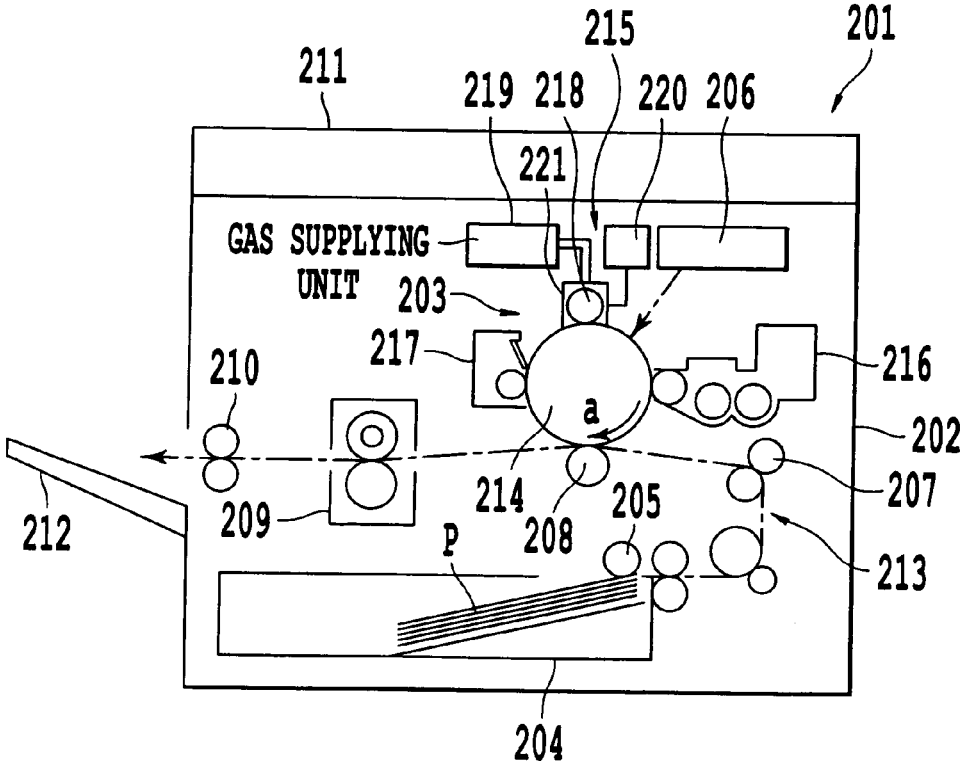
FIG. 5 is a longitudinal sectional side view of a schematic structure of a copying machine that is an image forming apparatus according to a fourth embodiment of the invention.
Figure 6:
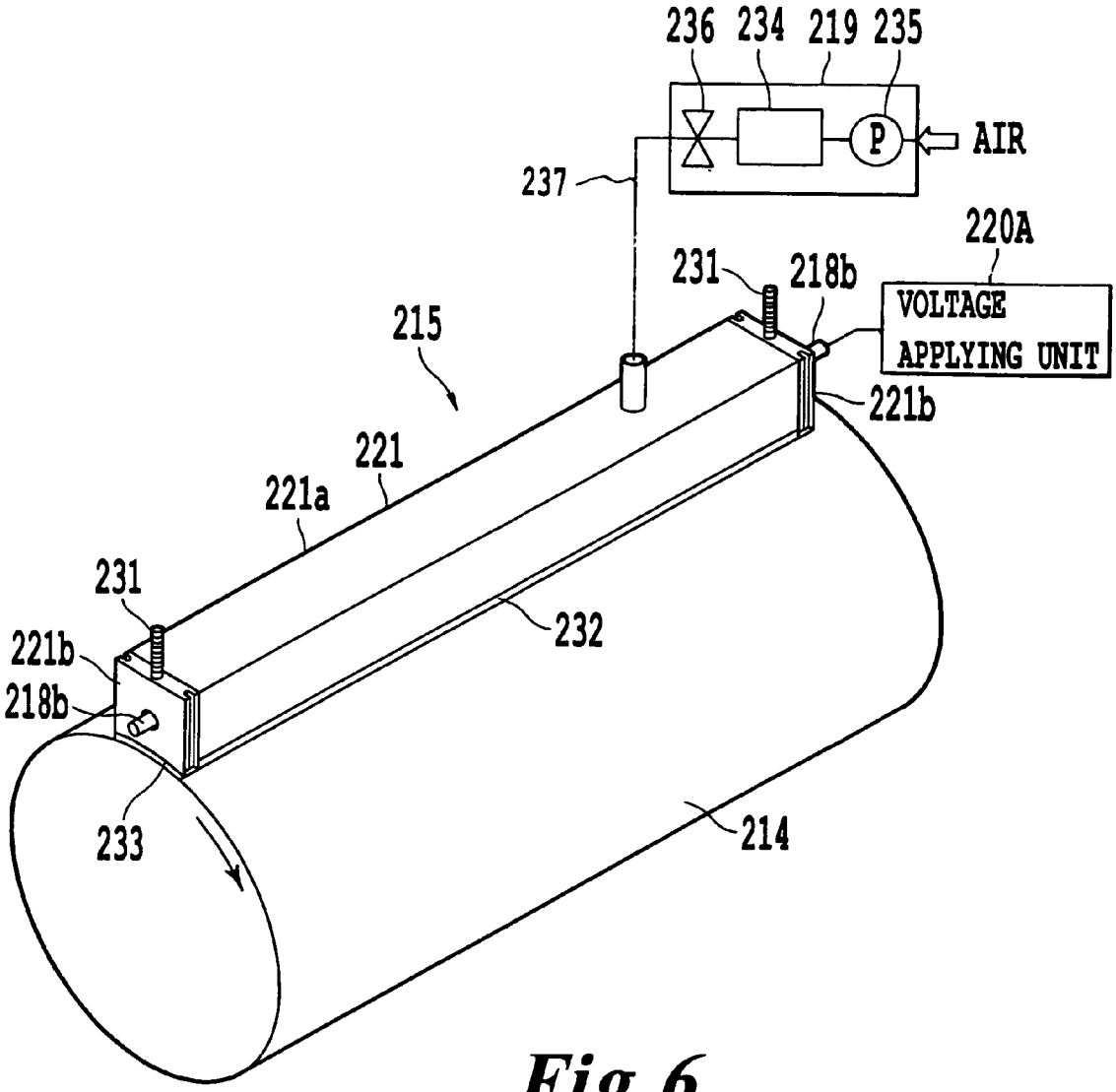
FIG. 6 is a perspective view of a charging device.
Figure 7:
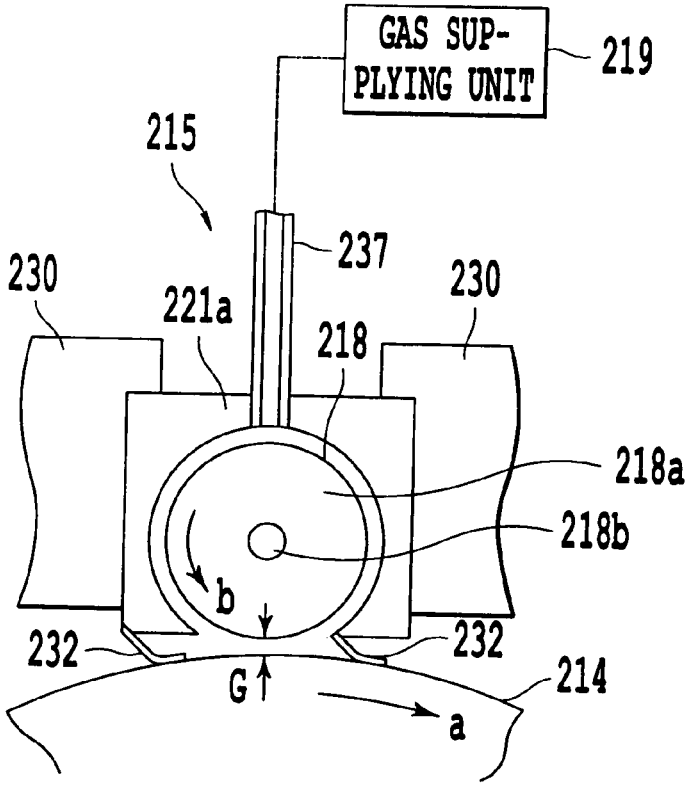
FIG. 7 is a longitudinal sectional side view of the charging device.
Figure 8:
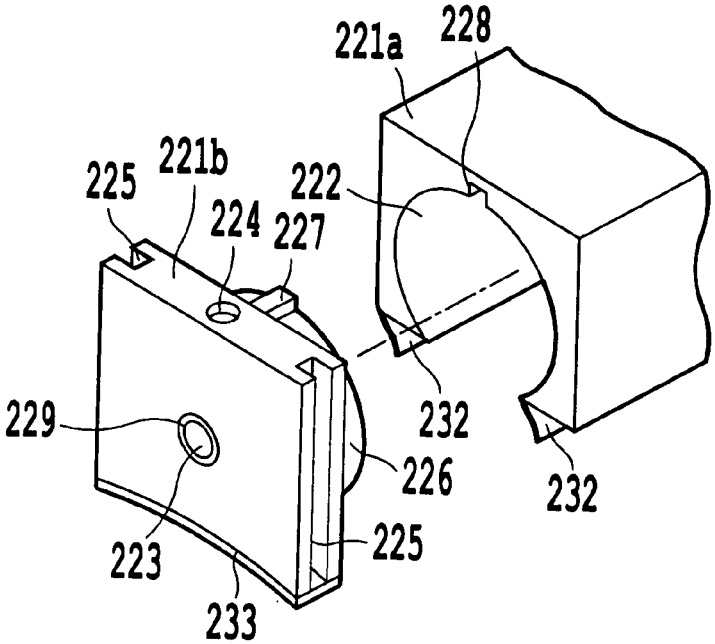
FIG. 8 is a disassembled perspective view of a part of the charging device.

A fourth embodiment of the invention will be explained with reference to FIGS. 5 to 10. FIG. 5 is a longitudinal sectional side view of a schematic structure of a copying machine serving as an image forming apparatus. FIG. 6 is a perspective view of a charging device. FIG. 7 is a longitudinal sectional side view of the charging device. FIG. 8 is a disassembled perspective view of a part of the charging device.

As shown in FIG. 5, a printer engine 203, a sheet feeding unit 204, a sheet feeding roller 205, an exposing device 206, a registration roller 207, a transfer device 208, a fixing device 209, a sheet discharge roller 210, and the like are provided in a body case 202 of a copying machine 201 serving as an image forming apparatus. A scanner 211 for reading an image of an original is provided above the body case 202. A conveying path 213, on which a recording medium P fed from the sheet feeding unit 204 is conveyed to a sheet discharge tray 212, is formed in the body case 202. The sheet feeding roller 205, the registration roller 207, the printer engine 203, the transfer device 208, the fixing device 209, the sheet discharge roller 210, and the like are arranged on this conveying path 213.

The printer engine 203 is a unit that forms a toner image corresponding to an image of an original read by the scanner 211. The printer engine 203 includes a photosensitive drum 214 serving as a photosensitive member, a charging device 215, a developing device 216, and a cleaning device 217. When a toner image is formed by the printer engine 203, the photosensitive drum 214 connected to a motor (not shown) is driven by the motor to rotate in a direction of arrow "a" around a centerline thereof, and an outer peripheral surface of the photosensitive drum 214 is uniformly charged by the charging device 215. The uniformly charged photosensitive drum 214 is exposed by a laser beam emitted from the exposing device 206. The laser beam emitted from the exposing device 206 is light that is emitted based on image data corresponding to the image of the original read by the scanner 211. An electrostatic latent image corresponding to the image of the original is formed on the outer peripheral surface of the photosensitive drum 214 by the exposure with the laser beam.

A toner is supplied from the developing device 216 to the photosensitive drum 214 on which the electrostatic latent image is formed, and the supplied toner is deposited on the electrostatic latent image, whereby a toner image is formed on the photosensitive drum 214. This toner image is transferred onto the recording medium P, which is conveyed on the conveying path 213, by an action of the transfer device 208. The outer peripheral surface of the photosensitive drum 214 after the toner image is transferred onto the recording medium P is cleaned by the cleaning device 217 to remove the toner that is not transferred onto the recording medium P and remains on the photosensitive drum 214.

The recording medium P having the toner image transferred thereon is continuously conveyed on the conveying path 213, and the toner on the recording medium P is melted by application of heat and pressure in the fixing device 209. The melted toner is welded to the recording medium P, whereby the toner image is fixed on the recording medium P.

The charging device 215 will be explained. The charging device 215 includes a charging roller 218 serving as a charging unit, a case 221 that houses the charging roller 218, a gas supplying unit 219, and a voltage applying unit 220A.

The charging roller 218 is disposed in parallel with the photosensitive drum 214 along a longitudinal direction of the photosensitive drum 214. The charging roller 218 is formed by a roller section 218*a* formed of a conductive material or the like obtained by dispersing conductive fine particles in resin, a shaft section 218*b* formed of stainless steel or the like, and large diameter sections (not shown) formed at both ends in the longitudinal direction of the roller section 218*a*. A motor (not shown) is connected to the shaft section 218*b*, and the charging roller 218 is driven by the motor to rotate in a direction of arrow "b" around a centerline thereof. When the charging roller 218 is arranged in parallel with the photosensitive drum 214 to be opposed the same, the large diameter sections come into abutment against the outer peripheral surface at both ends in the longitudinal direction of the photosensitive drum 214 to secure a gap "G" of a predetermined dimension between the roller section 218*a* and the outer peripheral surface of the photosensitive drum 214. This gap portion is set as an area where corona discharge is performed between the charging roller 218 and the photosensitive drum 214. In other words, in this embodiment, a non-contact charging method, in which the charging roller 218 and the photosensitive drum 214 are arranged close to each other in a non-contact manner to charge the photosensitive drum 214, is adopted.

The voltage applying unit 220A is connected to one end side of the shaft section 218*b* of the charging roller 218. This voltage applying unit 220A has a DC voltage generating unit and an AC voltage generating unit and applies a voltage obtained by superimposing an AC voltage on a DC voltage to the charging roller 218. Corona discharge is generated in the portion of the gap "G" between the roller section 218*a* and the photosensitive drum 214 by this voltage application, and the outer peripheral surface of the photosensitive drum 214 is uniformly charged by this corona discharge. In this case, for example, a DC voltage of −750 volts is generated in DC voltage generating unit and an AC voltage of a peak-to-peak voltage about twice as large as a breakdown voltage is generated in the AC voltage generating unit.

The case 221 is formed by a body case 221*a* formed in a long shape, which houses the charging roller 218, and a side plate 221*b* connected to both ends in a longitudinal direction of the body case 221*a*. The case 221 is arranged to surround the charging roller 218, an area where corona discharge is performed between the charging roller 218 and the photosensitive drum 214, and an area on the outer peripheral surface of the photosensitive drum 214 that is charged by corona discharge. A space 222 capable of housing the charging roller 218 is formed in the body case 221*a*. A through hole 223, a recess 224, an engaging groove 225, an engaging protrusion 226, a positioning protrusion 227, and the like are formed in the side plate 221*b*. The body case 221*a* and the side plate 221*b* are coupled by fitting the engaging protrusion 226 in an end of the space 222 and fitting the positioning protrusion 227 in a positioning recess 28 formed in the body case 221*a*. When the charging roller 218 is housed in the space 222 of the body case 221*a* and the side plate 221*b* is coupled to both ends of the body case 221*a*, the shaft section 218*b* of the charging roller 218 is located in a position for piercing through the through hole 223. A shaft seal 229, which is brought into sliding contact with the outer peripheral surface of the shaft section 218*b*, is attached to an inner peripheral portion of the through hole 223.

The case 221 housing the charging roller 218 in the inside is attached to the inside of the body case 202 by engaging the engaging groove 225 with a projected portion 230 provided in the body case 202. The case 221 is made capable of moving slidingly in directions, in which the case 221 comes into contact with and separates from the photosensitive drum 214, by the engagement of the engaging groove 225 and the projected portion 230. An end of a compression spring 231 is fit in the recess 224 of the side plate 221*b*. The other end of the compression spring 231 is brought into abutment against a fixing member (not shown), and the case 221 is biased toward the photosensitive drum 214 side by a biasing force of the compression spring 231.

A seal member 232, which extends along the longitudinal direction of the photosensitive drum 214 is pasted at an edge opposed to the outer peripheral surface of the photosensitive drum 214 in the body case 221*a*. The seal member 232 is a thin sheet-like member consisting of a urethane rubber material and has flexibility, and a top end of the seal member 232 is in sliding contact with the outer peripheral surface of the photosensitive drum 214. In addition, a seal member 233, which is formed in an arc shape and is in sliding contact with the outer peripheral surface of the photosensitive drum 214, is pasted to an edge opposed to the outer peripheral surface of the photosensitive drum 214 in the side plate 221*b*. The seal member 233 is a member formed in a two layer structure of foamed polyurethane and a fluorine resin tape. The fluorine resin tape is in sliding contact with the outer peripheral surface of the photosensitive drum 214.

When the case 221 housing the charging roller 218 is attached to a predetermined position in the body case 202, the case 221 is biased in the direction of the photosensitive drum 214 by a biasing force of the compression spring 231 and the large diameter sections at both ends of the charging roller 218 are brought into abutment against the outer peripheral surface of the photosensitive drum 214. Consequently, the case 221 and the charging roller 218 are positioned, and the gap "G" between the roller section 218*a* and the photosensitive drum 214 is maintained to be constant. When the case 221 housing the charging roller 218 is attached to the predetermined position in the body case 202, the seal members 232 and 233 are brought into abutment against the outer peripheral surface of the photosensitive drum 214. Consequently, air tightness of a space in which the charging roller 218 is housed in the case 221 is maintained, and intrusion of the atmosphere into this space is prevented.

The gas supplying unit 219 is a mechanism that supplies a gas, which has a lower breakdown voltage lower than that in the atmosphere, to the space in which the charging roller 218 is housed in the case 221. In this embodiment, as the gas having a lower breakdown voltage than that in the atmosphere, a gas obtained by replacing a part of oxygen in the atmosphere with nitrogen (nitrogen enriched gas) is used. This gas supplying unit 219 includes a nitrogen enriching film 234 that separates and removes oxygen in the atmosphere, a pump 235 that sucks the atmosphere and feeds the atmosphere to the nitrogen enriching film 234 side, and a valve 236 that controls a supply amount of a gas from which oxygen is removed by the nitrogen enriching film 234 (i.e., a gas in which a ratio of nitrogen is increased by replacing a part of oxygen in the atmosphere with nitrogen). A supply pipe 237 for supplying the gas (nitrogen enriched gas) from the gas supplying unit 219 to the inside of the case 221 is connected between the gas supplying unit 219 and the case 221. It is possible to bring an oxygen concentration in the gas as close as possible to 0% by setting an oxygen removing time by the nitrogen enriching film 234 long or repeating the removal of oxygen by the nitrogen enriching film 234. When a pressure in the case 221 reaches a certain value, the gas supplied from the gas supplying unit 219 to the inside of the case 221 lifts the seal member 232, which is in abutment against the photosensitive drum 214, from the photosensitive drum 214 and is exhausted to the outside of the case 221.

Here, when corona discharge is performed in the air (nitrogen enriched air) created in the gas supplying unit 219, a breakdown voltage falls compared with the time when corona discharge is performed in the atmosphere. This is called the Paschen's law. It is possible to lower the breakdown voltage by replacing at least a part of oxygen in the atmosphere with at least one of helium, argon, and neon (see University lecture: Gas discharge phenomenon, p. 68, Table 4.1, Tokyo Denki University Press, first edition issued on Apr. 1, 1964).

Figure 9:
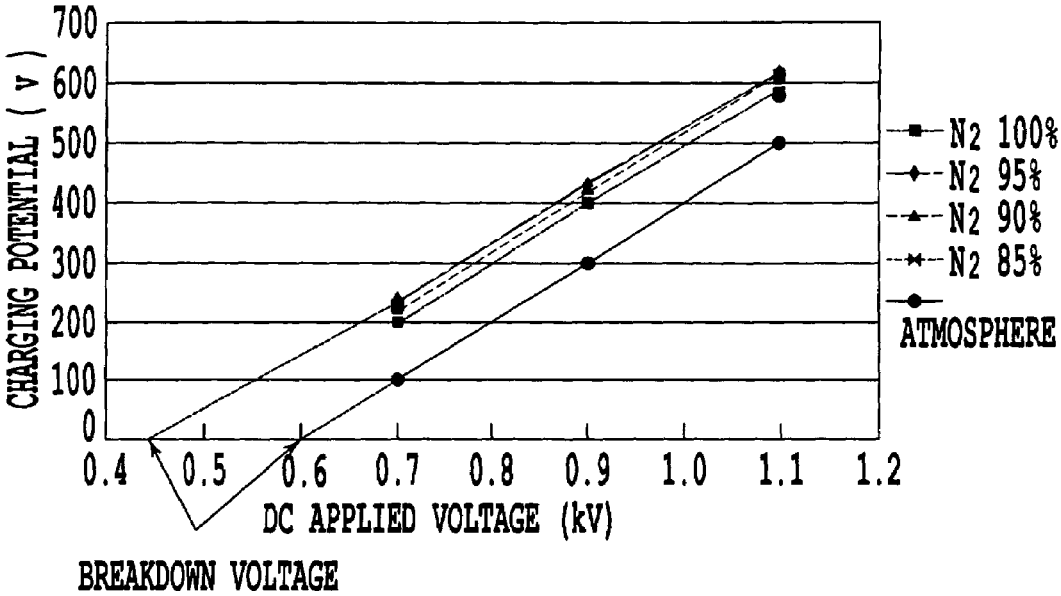
FIG. 9 is a graph of a relation between a nitrogen concentration and a breakdown voltage in a gas in an area where corona discharge is performed and a relation between a nitrogen concentration in a gas in an area where corona discharge is performed and a charging potential and a DC applied voltage of a photosensitive drum.

FIG. 9 is a graph of a relation between a nitrogen concentration and a breakdown voltage in a gas present in an area where corona discharge is performed and a relation between a nitrogen concentration in a gas present in an area where corona discharge is performed and a charging potential and a DC applied voltage of the photosensitive drum 214. According to the graph in FIG. 9, it was found that, when corona discharge was performed in a gas with a nitrogen concentration of 85% or more (nitrogen enriched gas), compared with the time when corona discharge was performed in the atmosphere, it was possible to lower a breakdown voltage by about 150 volts and lower a voltage, which was applied to the charging roller 218 to charge the photosensitive drum 214 to a target charging potential, by about 150 volts.

In the explanation of this embodiment, the gas obtained by replacing oxygen in the atmosphere with nitrogen is used as an example. However, according to the Paschen's law, it is also possible to lower a breakdown voltage and lower a voltage to be applied to obtain a necessary charging potential when oxygen in the atmosphere is replaced with helium, argon, or neon.

In addition, according to the Paschen's law, since helium, argon, and neon has low breakdown voltages compared with nitrogen, it is also possible to lower a breakdown voltage and lower a voltage to be applied to obtain a necessary charging voltage when nitrogen in the atmosphere is replaced with helium, argon, or neon without changing a ratio of oxygen in the atmosphere. Note that, when helium, argon, or neon is used, a container storing the gas is used to supply helium, argon, or neon instead of nitrogen removed by the oxygen enriching film.

Figure 10:
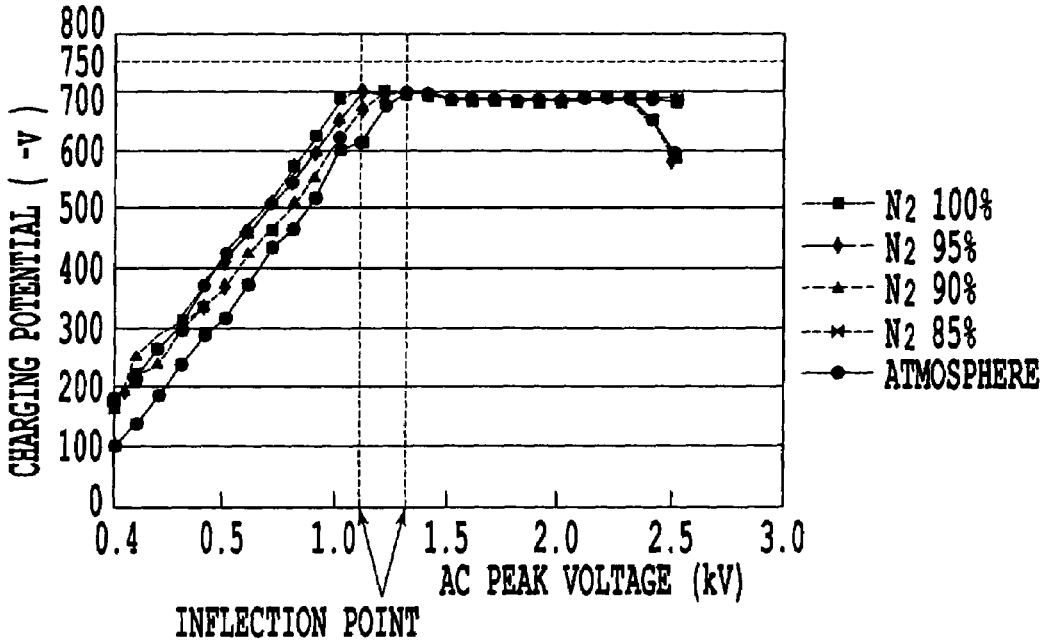
FIG. 10 is a graph of a relation between a nitrogen concentration in a gas in an area where corona discharge is performed and a peak-to-peak voltage of an AC voltage at an inflection point where a charging potential becomes constant at the time when a voltage obtained by superimposing an AC voltage on a DC voltage is applied to perform corona discharge.

FIG. 10 is a graph of a result obtained by measuring a peak-to-peak voltage of an AC voltage at an inflection point where a charging potential of the photosensitive drum 214 becomes constant at the time when a voltage obtained by superimposing an AC voltage on a DC voltage is applied to perform corona discharge in a nitrogen enriched gas and in the atmosphere to charge the photosensitive drum 214. Note that the applied DC voltage is set to −750 volts.

According to the graph in FIG. 10, it was found that, when corona discharge was performed in a nitrogen enriched gas, it was possible to lower a peak-to-peak voltage of an AC voltage at an inflection point by about 200 volts compared with the time when corona discharge was performed in the atmosphere. Consequently, it is possible to set a voltage applied to the charging roller 218 from the voltage applying unit 220A lower than a voltage that is applied when the photosensitive drum 214 is charged by corona discharge in the atmosphere. Therefore, it is possible to reduce an impact on the photosensitive drum 214 caused by repetition of corona discharge for charging the photosensitive drum 214 uniformly, control deterioration of the photosensitive drum 214, and improve durability of the photosensitive drum 214. Moreover, since the voltage to be applied falls, it is possible to reduce power consumption for charging.

Figure 11:
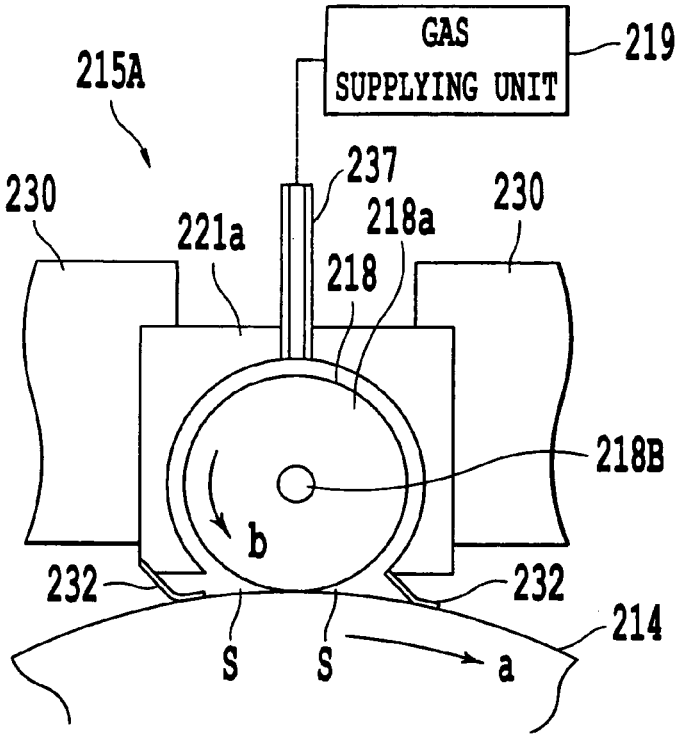
FIG. 11 is a longitudinal sectional side view of a charging device according to a fifth embodiment of the invention.

A fifth embodiment of the invention will be explained with reference to FIG. 11. Note that, in this embodiment and other embodiments, components identical with or equivalent to those described in the embodiments described above are denoted by the identical reference numerals and signs, and explanations of the components are omitted. FIG. 11 is a longitudinal sectional side view of a charging device.

A basic structure of this embodiment is the same as that in the fourth embodiment. This embodiment is different from the first embodiment in that, whereas the non-contact charging method is adopted in the charging device 215 of the fourth embodiment, the contact charging method is adopted in a charging device 215A of this embodiment. In other words, in this embodiment, the roller section 218*a* of the charging roller 218 is arranged in contact with the outer peripheral surface of the photosensitive drum 214. Corona discharge between the charging roller 218 and the photosensitive drum 214 occurs in gap portions "S" of a wedge shape in front of and behind the contact portion of the roller section 218*a* and the photosensitive drum 214.

In this embodiment, compared with the fourth embodiment, although a charging system is changed from non-contact charging to contact charging, other structures are the same as those in the fourth embodiment. Thus, in this embodiment, the same actions and effects as those in the fourth embodiment are obtained.

Figure 12:
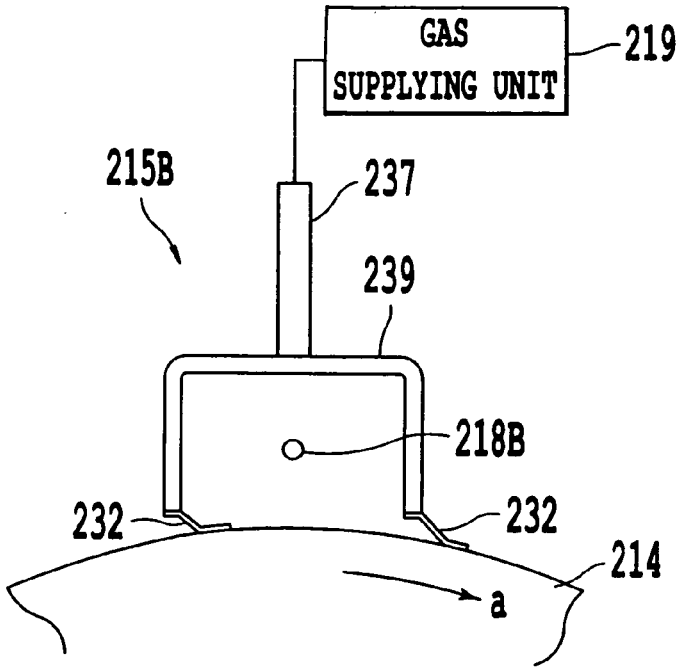
FIG. 12 is a longitudinal sectional view of a charging device according to a sixth embodiment of the invention.

A sixth embodiment of the invention will be explained with reference to FIG. 12. FIG. 12 is a longitudinal sectional side view of a charging device.

In a charging device 215B of this embodiment, a corona discharge method is adopted. In this charging device 215B, a wire 238 serving as a charging section is disposed in parallel with the photosensitive drum 214. A voltage applying unit (not shown) for applying a DC voltage is connected to the wire 238. A case 39, which surrounds the wire 238, an area where corona discharge is performed around the wire 238, and an area that is charged when ions generated by corona discharge on the outer peripheral surface of the photosensitive drum 214 are deposited thereon, is provided. The supply pipe 237, through which a gas produced by the gas supplying unit 219 (nitrogen enriched gas) is supplied, a seal member 32 for preventing intrusion of the atmosphere into the case 39, and the like are provided in the case 39.

With such a structure, in this embodiment, it is also possible to lower a breakdown voltage and set a voltage, which is applied to the wire 238 to charge the photosensitive drum 214 to a necessary charging potential, lower than a voltage at the time when corona discharge is performed in the atmosphere. Consequently, it is possible to reduce an impact on the photosensitive drum 214 by corona discharge, control deterioration of the photosensitive drum 214, and reduce power consumption for charging.

Figure 13:
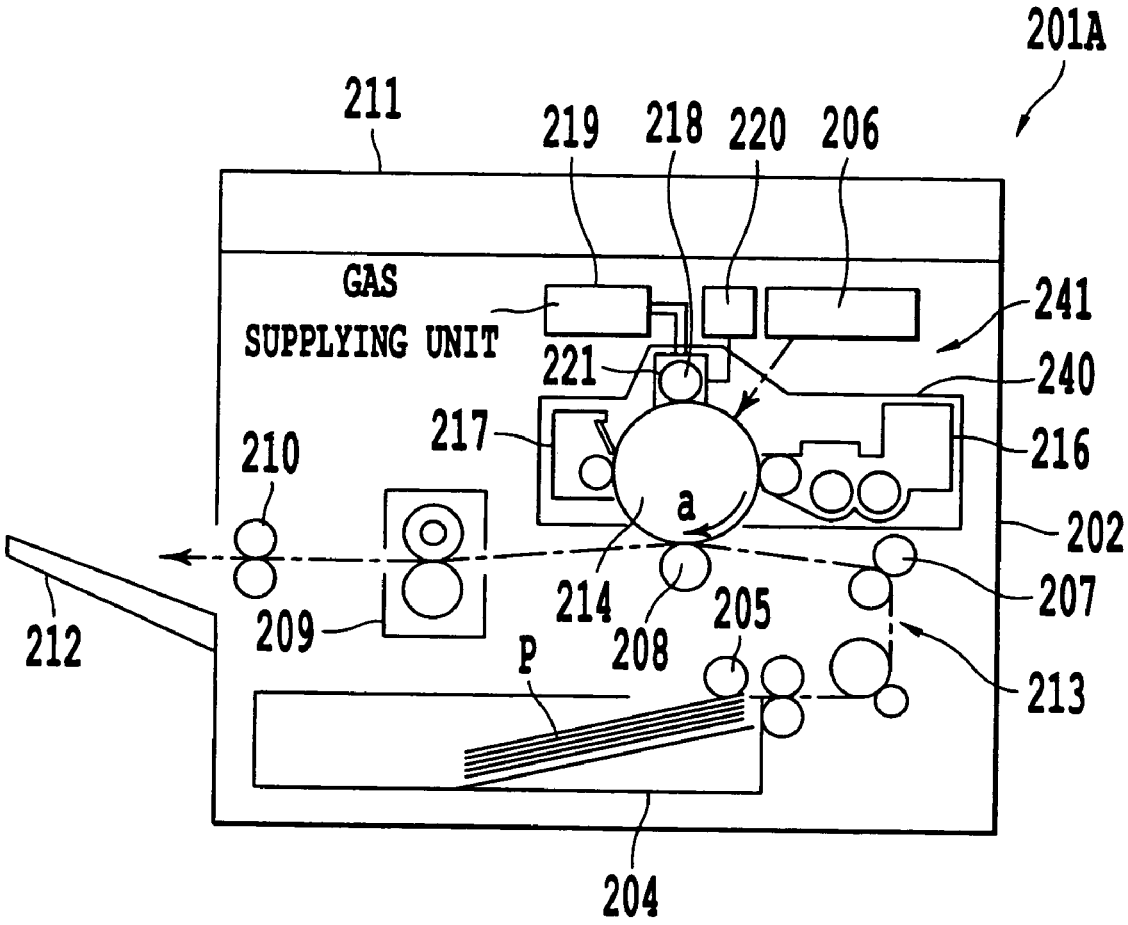
FIG. 13 is a longitudinal sectional view of a schematic structure of a copying machine that is an image forming apparatus according to a seventh embodiment of the invention.

A seventh embodiment of the invention will be explained with reference to FIG. 13. FIG. 13 is a longitudinal sectional side view of a schematic structure of a copying machine serving as an image forming apparatus.

In a copying machine 201A of this embodiment serving as an image forming apparatus, a process cartridge 241, which houses the charging roller 218, the photosensitive drum 214, the developing device 216, and the cleaning device 217 in a cartridge case 240, is used. The process cartridge 241 is detachably mounted in the body case 202.

A connection mechanism (not shown), which connects the gas supplying unit 219 and the case 221, is provided to make it possible to supply a gas from the gas supplying unit 219 provided in the body case 202 to the inside of the case 221 by mounting the process cartridge 241 in the body case 202. In addition, a connection mechanism (not shown), which connects the voltage applying unit 220A and the charging roller 218, is provided to make it possible to apply a voltage from the voltage applying unit 220A to the charging roller 218 by mounting the process cartridge 241 in the body case 202.

With such a structure, in the copying machine 201A using this process cartridge 241, a gas produced by the gas supplying unit 219 (nitrogen enriched gas) is supplied to surroundings of the charging roller 218 in the process cartridge 241, and a voltage to be applied from the voltage applying unit 220A to the charging roller 218 is low. Thus, it is possible to realize actions and effects same as those realized by the charging device 215 of the copying machine 201 explained in the fourth embodiment.

In addition, in this embodiment, when any one of members constituting the process cartridge 241 exhausts a life or breaks down, the entire process cartridge 241 is replaced. Consequently, compared with the time when the respective members such as the photosensitive drum 214 and the charging device 215 are replaced individually, it is possible to maintain a positional relation of the respective members constant, maintain charging performance of the photosensitive drum 214, development performance by the developing device 216, and the like satisfactory, and perform stable image formation.

Figure 14:
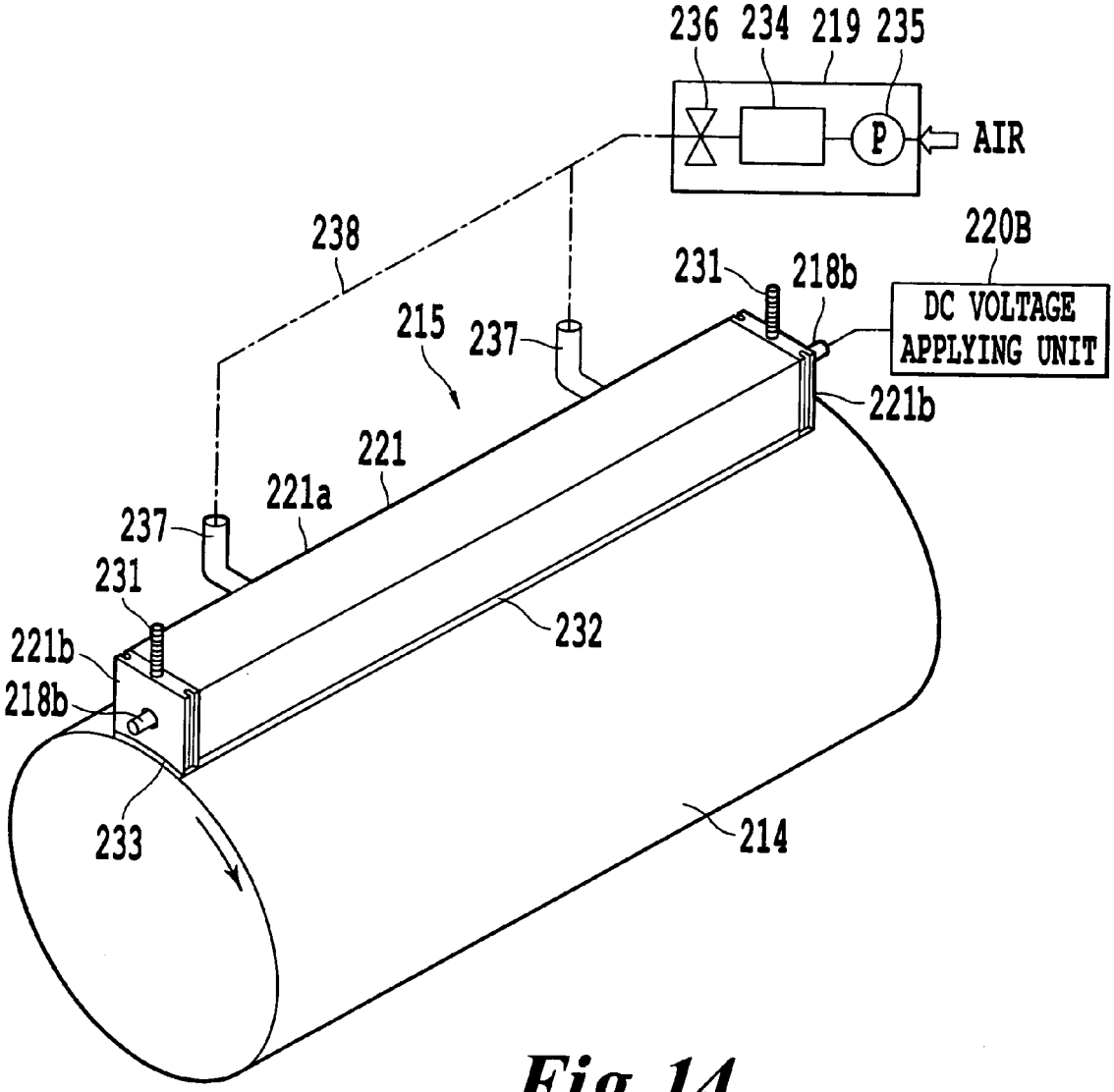
FIG. 14 is a perspective view of a charging device.

An eighth embodiment of the invention will be explained with reference to FIGS. 14 and 15 and FIGS. 16A to 16D. FIG. 14 is a perspective view of a charging device. FIG. 15 is a longitudinal sectional side view of the charging device. FIGS. 16A to 16D are photographs of a result of observing a background contamination state by performing development processing after charging a photosensitive member with a nitrogen concentration of a gas in a discharge area varied. Note that, since a basic structure of a copying machine is the same as those in the fourth embodiment shown in FIGS. 5 to 10, only differences will be explained here.

As shown in FIG. 14, a DC voltage applying unit 220B is connected to one end side of the shaft section 218*b* of the charging roller 218. This DC voltage applying unit 220B has a DC voltage generating unit and applies a generated DC voltage to the charging roller 218. Corona discharge is generated in the portion of the gap "G" between the roller section 218*a* and the photosensitive drum 214 by this voltage application, and the outer peripheral surface of the photosensitive drum 214 is uniformly charged by this corona discharge.

Since a structure of the case 221 is the same as the structure shown in FIG. 8, an explanation of the structure is omitted here.

As shown in FIG. 15, a gas supplying unit 219B is a mechanism that supplies a gas having a nitrogen concentration higher than that of the atmosphere to the space where the charging roller 218 is housed in the case 221. This gas supplying unit 219B includes the nitrogen enriching film 234 that separates and removes oxygen in the atmosphere, the pump 235 that sucks the atmosphere and feeds the atmosphere to the nitrogen enriching film 234 side, and the valve 236 that controls a supply amount of a gas from which oxygen is removed by the nitrogen enriching film 234 (i.e., a gas having a nitrogen concentration higher than that of the atmosphere). In this gas supplying unit 219B, it is possible to generate a gas having a nitrogen concentration higher than that of the atmosphere by supplying the atmosphere to the nitrogen enriching film 234 according to drive of the pump 235 and separating and removing oxygen with the nitrogen enriching film 234. It is possible to bring a nitrogen concentration in the gas as close as possible to 100% by setting an oxygen removing time by the nitrogen enriching film 234 long or repeating the removal of oxygen by the nitrogen enriching film 234.

Plural introducing sections 37, which introduce a gas generated by the gas supplying unit 219B (a gas having a nitrogen concentration higher than that of the atmosphere), is provided in the case 221. Although two introducing sections 37 are described in this embodiment as an example, three or more introducing sections 37 may be provided. A pipe 38, through which the gas generated by the gas supplying unit 219B (the gas having a nitrogen concentration higher than that of the atmosphere) is supplied, is connected to these introducing sections 37. The introducing sections 37 are arranged along a rotation center direction (width direction) of the photosensitive drum 214 and arranged further on an upstream side than an opposed position of the photosensitive drum 214 and the charging roller 218 along a rotating direction of the photosensitive drum 214. The gas supplied from the introducing sections 37 to the inside of the case 221 (the gas having a nitrogen concentration higher than that of the atmosphere) is supplied to the discharge area. When a pressure in the case 221 reaches a certain value, the gas supplied from the gas supplying unit 219B to the inside of the case 221 (the gas having a nitrogen concentration higher than that of the atmosphere) lifts the seal member 232, which is in abutment against the photosensitive drum 214, from the photosensitive drum 214 and is exhausted to the outside of the case 221.

FIGS. 16A to 16D are schematics for explaining the result of charging the photosensitive drum 214 with a nitrogen concentration of a gas supplied to the inside of the case 221 varied and performing development processing in the developing device 216 without performing exposure. In FIG. 16A, the nitrogen concentration is 80% that is substantially the same as that of the atmosphere. In FIGS. 16B, 16C, and 16D, the nitrogen concentration is 85%, 90%, and 100%, respectively. In FIGS. 16A to 16D, a black dotted portion is a portion where a toner is deposited by the development processing because a charging state is low. Note that a DC voltage of −1.4 kilovolts was applied from the DC voltage applying unit 220B to the charging roller 218.

As it is seen from FIGS. 16A to 16D, by setting the nitrogen concentration of the gas in the discharge area higher than that of the atmosphere and in accordance with an increase in the nitrogen concentration, a charging state of the photosensitive drum 214 becomes uniform even if a voltage applied to the charging roller 218 is a DC voltage, and a quantity of toner deposited by the development processing is reduced. Moreover, since a voltage applied to the charging roller 218 is a DC voltage, unlike the time when an AC voltage is applied, discharge is never repeated according to a frequency of the AC voltage, and deterioration of the photosensitive drum 214 due to an impact of discharge is reduced.

Figure 17:
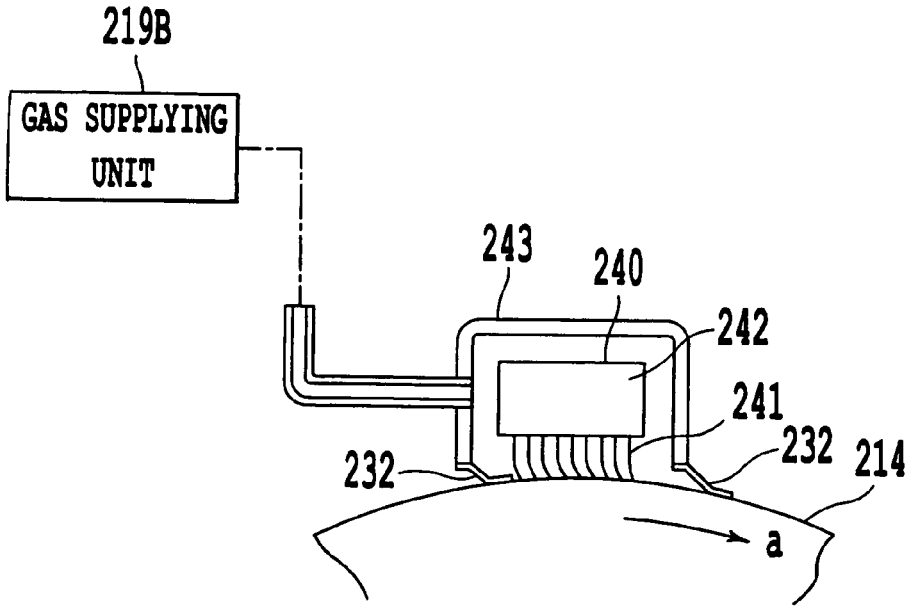
FIG. 17 is a longitudinal sectional side view of a part of a charging device according to a ninth embodiment of the invention.

A ninth embodiment of the invention will be explained with reference to FIG. 17. Note that components same as those explained in FIGS. 5 to 16 are denoted by the same reference numerals and signs, and explanations of the components are omitted (the same holds true for an embodiment to be explained below).

In this embodiment, a charging brush 240 is used as a charging unit instead of the charging roller 218 explained in the eighth embodiment. The charging brush 240 is formed by a brush 2411 formed of a conductive material and a holding section 242 in which the brush 2411 is flocked. A DC voltage of −1.0 kilovolt was applied from the DC voltage applying unit 220B to the charging brush 240. A case 243, which surrounds the charging brush 240, a discharge area around the brush 2411, and an area of the photosensitive drum 214 to be charged by discharge, is provided. A gas having a nitrogen concentration higher than that of the atmosphere is supplied to the inside of the case 243 from the gas supplying unit 219B.

When charging and development were performed without housing this charging brush 240 in the case 243 and without supplying the gas from the gas supplying unit 219B (the gas having a nitrogen concentration higher than that of the atmosphere), unevenness in a rotating direction corresponding to the brush 2411 occurred on an image. When charging by the brush 2411 is performed, since the photosensitive drum 14 and a part of the brush 2411 are in contact with each other, there is an advantage that it is easy to control a gap. However, since the photosensitive drum 214 is charged by discharge in a gap formed between the brush 2411 and the photosensitive drum 214 rather than injection charging in the contact portion. Thus, it is considered that discharge unevenness corresponding to brush fiber occurs to form streaks.

On the other hand, when charging and development was performed by setting this charging brush 240 in the case 243 and supplying a gas having nitrogen concentration higher than that of the atmosphere to the inside of the case 243, no streak-like unevenness was observed, and a development state with satisfactory uniformity was obtained.

Figure 18:
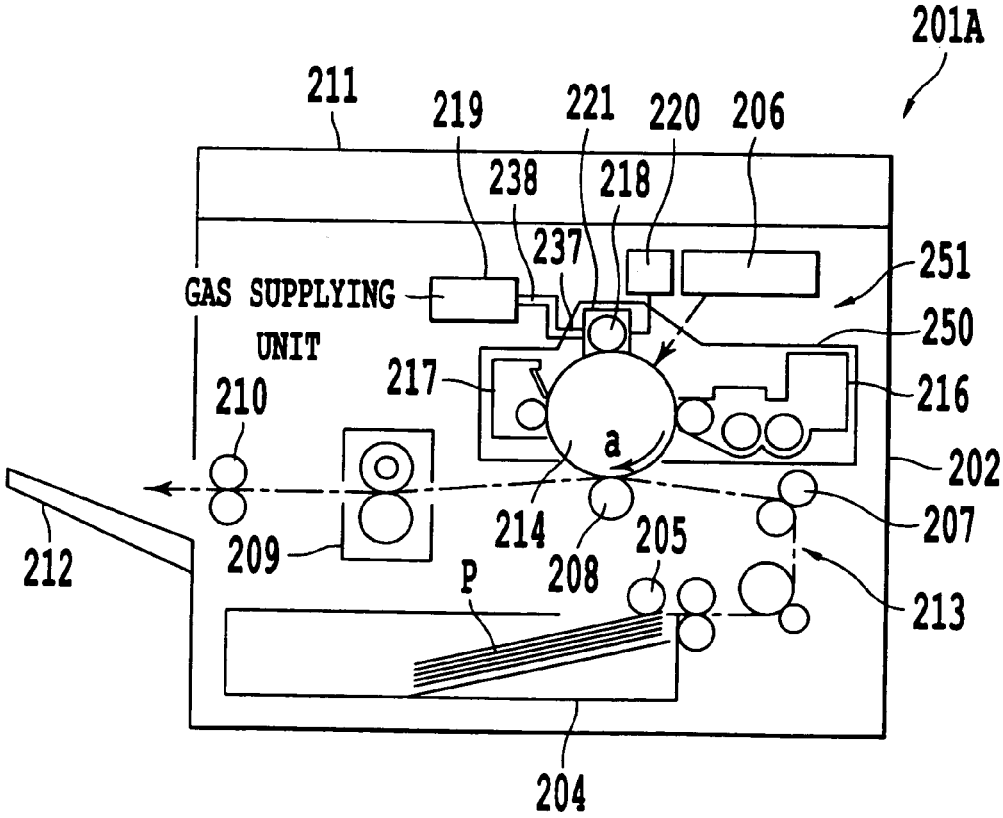
FIG. 18 is a longitudinal sectional side view of a schematic structure of a copying machine that is an image forming apparatus according to a tenth embodiment of the invention.

A tenth embodiment of the invention will be explained with reference to FIG. 18. FIG. 18 is a longitudinal sectional side view of a schematic structure of a copying machine serving as an image forming apparatus.

In a copying machine 201B of this embodiment serving as an image forming apparatus, a process cartridge 251, which houses the charging roller 218, the photosensitive drum 214, the developing device 216, and the cleaning device 217 in a cartridge case 250, is used. The process cartridge 251 is detachably mounted in the body case 202.

A connection mechanism (not shown), which connects the gas supplying unit 219B and the case 221, is provided to make it possible to supply a gas from the gas supplying unit 219B provided in the body case 202 to the inside of the case 221 by mounting the process cartridge 251 in the body case 202. In addition, a connection mechanism (not shown), which connects the DC voltage applying unit 220B and the charging roller 218, is provided to make it possible to apply a voltage from the DC voltage applying unit 220B to the charging roller 218 by mounting the process cartridge 251 in the case 202.

With such a structure, in the copying machine 201B using this process cartridge 251, a gas produced by the gas supplying unit 219B (a gas having a nitrogen concentration higher than that of the atmosphere) is supplied to the inside of the case 221 in the process cartridge 251, and a DC voltage is applied from the DC voltage applying unit 220B. Thus, it is possible to realize actions and effects same as those realized by the charging roller 218 of the copying machine 201 explained in the eighth embodiment.

In addition, in this embodiment, when any one of members constituting the process cartridge 251 exhausts a life or breaks down, the entire process cartridge 251 is replaced. Consequently, compared with the time when the respective members such as the photosensitive drum 214 and the developing device 216 are replaced individually, it is possible to maintain a positional relation of the respective members constant, maintain charging performance of the photosensitive drum 214, development performance by the developing device 216, and the like satisfactory, and perform stable image formation.

According to the invention, the charging device, the process cartridge, and the image forming apparatus include: the gas separating unit that varies a ratio of components of the air present near the opposed portion of the image bearing member and the charging unit; and the gas electrolyzing unit that electrolyzes moisture in the air present near the opposed portion of the image bearing member and the charging unit. Thus, it is possible to provide a quiet charging apparatus, process cartridge, and image forming apparatus realizing a high image quality that can reduce generation of discharge products in a charging process with a relatively simple and inexpensive structure without causing a large air flow and without lowering humidity of the air.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A charging device comprising:

a charging unit that charges an image bearing member;

a gas separating unit that controls a percentage of air present between the image bearing member and the charging unit;

a gas electrolyzing unit that electrolyzes moisture in the air present between the image bearing member and the charging unit; and a case that surrounds the charging unit, the case including a plurality of ventilations, wherein the gas separating unit includes a nitrogen enriching unit that includes a nitrogen enriching film, which is set in any one of the ventilations; and a first pressure adjusting unit, which forms a pressure difference between an inside and an outside of the case, wherein the gas separating unit supplies nitrogen enriched air to the inside of the case and the gas electrolyzing unit includes a solid polymer electrolyte film provided in another one of the ventilations;

a porous cathode that is provided on a surface facing an inner side of the case in the solid polymer electrolyte film and connected to a cathode of a power supply unit; and a porous anode that is provided on a surface facing an outer side of the case in the solid polymer electrolyte film and connected to an anode of the power supply unit.

2. The charging device according to claim 1, wherein the gas separating unit further includes an oxygen enriching unit that includes an oxygen enriching film, which is set in one of the ventilations; and a second pressure adjusting unit, which forms a pressure difference between an inside and an outside of the case, and supplies an oxygen enriched air to the inside of the case.

3. The charging device according to claim 2, wherein the second pressure adjusting unit has a depressurizing chamber.

4. The charging device according to claim 1, wherein the first pressure adjusting unit further includes an oxygen enriching unit that includes an oxygen enriching film, which is set in one of the ventilations; and the charging device further comprising:

a second pressure adjusting unit, which forms a pressure difference between an inside and an outside of the case, and supplies oxygen enriched air to the inside of the case.

5. The charging device according to claim 4, wherein the first pressure adjusting unit has a pressurizing chamber.

6. The charging device according to claim 4, wherein the second pressure adjusting unit has a depressurizing chamber.

7. The charging device according to claim 1, wherein a humidity adjusting agent is filled in the case.

8. The charging device according to claim 7, wherein a water absorbing resin dispersion is provided on an inner side of the case as the humidity adjusting agent.

9. The charging device according to claim 1, wherein the ventilations are openings in the case.

10. The charging device according to claim 1, wherein the charging unit is a contact type charging unit.

11. The charging device according to claim 1, wherein the first pressure adjusting unit has a pressurizing chamber.

* * * * *